US011114083B2

(12) United States Patent
Taki et al.

(10) Patent No.: US 11,114,083 B2
(45) Date of Patent: Sep. 7, 2021

(54) ANTI-SNORING APPARATUS, ANTI-SNORING METHOD, AND PROGRAM

(71) Applicant: MaRI Co., Ltd., Kyoto (JP)

(72) Inventors: Hirofumi Taki, Kyoto (JP); Rodrigo Bornhausen-Demarch, Sao Paulo (BR); Yizhe Wu, Shanghai (CN); Rie Tomizawa, Suita (JP)

(73) Assignee: MaRI Co., Ltd., Kyoto (JP)

( * ) Notice: Subject to any disclaimer, the term of this patent is extended or adjusted under 35 U.S.C. 154(b) by 0 days.

(21) Appl. No.: 16/616,282

(22) PCT Filed: May 24, 2018

(86) PCT No.: PCT/IB2018/000733
§ 371 (c)(1),
(2) Date: Nov. 22, 2019

(87) PCT Pub. No.: WO2018/215836
PCT Pub. Date: Nov. 29, 2018

(65) Prior Publication Data

US 2020/0160828 A1 May 21, 2020

Related U.S. Application Data

(60) Provisional application No. 62/666,027, filed on May 2, 2018, provisional application No. 62/599,032, filed
(Continued)

(51) Int. Cl.
*G10K 11/178* (2006.01)
*H04R 1/40* (2006.01)
*H04R 3/00* (2006.01)

(52) U.S. Cl.
CPC ..... *G10K 11/17873* (2018.01); *H04R 1/406* (2013.01); *H04R 3/005* (2013.01); *G10K 2210/10* (2013.01)

(58) Field of Classification Search
CPC ..... G10K 11/178; G10K 11/17873; G10K 2210/10; H04R 1/406; H04R 3/005;
(Continued)

(56) References Cited

U.S. PATENT DOCUMENTS 5,444,786 A 8/1995 Raviv
2004/0234080 A1 * 11/2004 Hernandez ..... G10K 11/17823 381/71.11
(Continued)

FOREIGN PATENT DOCUMENTS

DE 197 06 645 A1 9/1998
DE 19706645 A1 * 9/1998 ..... G10K 11/178
(Continued)

OTHER PUBLICATIONS

European Office Action dated Jan. 10, 2020, in Patent Application No. 18755535.4, 3 pages.
(Continued)

*Primary Examiner* — Yogeshkumar Patel
(74) *Attorney, Agent, or Firm* — Oblon, McClelland, Maier & Neustadt, L.L.P.

(57) ABSTRACT

An anti-snoring apparatus including a low frequency sound generating device that applies a low frequency sound to a subject producing a snoring sound, and a controller including circuitry that converts the snoring sound to a received signal, obtain snoring sound information from the received signal, process the snoring sound information such that an impact of the snoring sound is determined based on the snoring sound information, and cause the low frequency sound generating device to apply the low frequency sound to the subject when the impact is higher than a threshold.

30 Claims, 16 Drawing Sheets

Related U.S. Application Data on Dec. 15, 2017, provisional application No. 62/511,263, filed on May 25, 2017.

(58) Field of Classification Search

CPC ..... A61F 5/56; A61F 5/566; A61B 5/4818; A61B 5/113; A61B 5/01; A61B 5/4809; A61B 5/4812; A61B 7/003

See application file for complete search history.

(56) References Cited

U.S. PATENT DOCUMENTS

| | | | | |
|---|---|---|---|---|
| 2016/0055842 | A1* | 2/2016 | DeFranks ..... | A61F 5/56 381/66 |
| 2017/0004818 | A1 | 1/2017 | Khatua | |
| 2017/0053637 | A1 | 2/2017 | DeFranks et al. | |
| 2017/0309267 | A1 | 10/2017 | DeFranks et al. | |

FOREIGN PATENT DOCUMENTS

| | | | | |
|---|---|---|---|---|
| DE | 10 2004 052 845 | A1 | | 5/2006 |
| JP | 2009-519802 | A | | 5/2009 |
| JP | 2017-202022 | A | | 11/2017 |
| KR | 20090078467 | A | * | 7/2009 |

OTHER PUBLICATIONS

International Search Report and Written Opinion dated Nov. 6, 2018 in PCT/IB2018/000733 filed on May 24, 2018, 16 pages.

* cited by examiner

ANTI-SNORING APPARATUS, ANTI-SNORING METHOD, AND PROGRAM

CROSS-REFERENCE TO RELATED APPLICATIONS

The present application is based upon and claims the benefits of priority to U.S. Provisional Application No. 62/511,263, filed May 25, 2017, and U.S. Provisional Application No. 62/599,032, filed Dec. 15, 2017, and U.S. Provisional Application No. 62/666,027, filed May 2, 2018. The entire contents of these applications are incorporated herein by reference.

TECHNICAL FIELD

The present invention is directed to an anti-snoring apparatus, an anti-snoring method, and a program that receives snoring sound of a subject and transmits low-frequency sound to a subject in order to stop snoring.

BACKGROUND ART

Snoring is a prevalent disorder among general population. The prevalence of chronic snoring is estimated to be 40% in adult men and 20% in adult women (NPL 1). The snoring sound is determined by many factors (NPL 2): including the route of breathing (NPL 3), upper airway narrowing (NPL 4), and sleep stage and body position (NPL 5).

Snoring is one of the important manifestations for obstructive sleep apnea (OSA) that causes medical morbidity and mortality (NPL 6). Therefore, most investors focus on OSA treatments (PL1, PL 2, PL 3, NPL 7). However, these treatments require behavior change or invasive procedure.

Snoring sound is also a large problem for the bed partner of a snorer. There are many attempts that suppress the impact of snoring sound. Ear plug is a most common solution to suppress the impact of snoring noise. However, ear plug also suppresses important sounds, e.g. the sound of alert system. In addition, the attachment of ear plug requires a behavior change. Noise cancelling system is an attempt that cancels snoring sound (PL 4); however, it requires a behavior change and it is impossible to suppress the snoring sound effectively. Another strategy employs a system with an eye cover that radiates flash light when snoring sound intensity exceeds a predetermined threshold (PL 5). The application tried to avoid affecting user's normal sleep; however, the attachment of an eye cover to a user requires a behavior change. Anti-snoring bed system (PL 6) attempts to stop snoring by changing the configuration of the bed. This system assumes the use of a special bed, that is, it is not applicable to subjects that use normal beds.

CITATION LIST PATENT LITERATURE

PL 1 T. R. Shantha, "Device for snoring and obstructive sleep apnea treatment," U.S. Pat. No. 9,072,613B2.

PL 2 F. Li, Z. Li, "Method and device for intelligently stopping snoring," WO2015027744A1.

PL 3 W. Li, "Anti-snoring device," U.S. Pat. No. 9,554,938 B2.

PL 4 G. Raviv, "Snoring suppression system," U.S. Pat. No. 5,444,786A.

PL 5 H. Bruckhoff, "Device for snoring prevention," EP0493719A1.

PL 6 H.-D. Lin, "Automated anti-snoring bed system," U.S. Pat. No. 8,418.289B2.

CITATION LIST NON PATENT LITERATURE

NPL 1 V. Hoffstein, "Apnea and snoring: state of the art and future directions," Acta Otorhinolaryngol Belg 2002; 56(2):205-36.

NPL 2 D. Pevernagie, R. M. Aarts, M. De Meyer, "The acoustics of snoring," Sleep Med Rev. 2010 April; 14(2): 131-44.

NPL 3 Liistro G, Stanescu D, Veriter C. Pattern of simulated snoring is different through mouth and nose. J Appl Physiol 1991; 70(6):2736-41.

NPL 4 S.J. Quinn, N. Daly, P. D. Ellis, "Observation of the mechanism of snoring using sleep nasendoscopy," Clin Otolaryngol 1995; 20(4):360-4.

NPL 5 H. Nakano, T. Ikeda, M. Hayashi, E. Ohshima, A. Onizuka, "Effects of body position on snoring in apneic and nonapneic snorers," Sleep 2003; 26(2):169-72.

NPL 6 N.M. Punjabi, "The Epidemiology of Adult Obstructive Sleep Apnea," Proc Am Thorac Soc. 2008 Feb. 15; 5(2):136-43.

NPL 7 http://www.sleepreviewmag.com/2014/09/alternative-therapies-obstructive-sleep-apnea/

SUMMARY OF THE INVENTION

According to an aspect of the present invention, an anti-snoring apparatus includes a low frequency sound generating device that applies a low frequency sound to a subject producing a snoring sound, and a controller including circuitry which converts the snoring sound to a received signal, obtains snoring sound information from the received signal, processes the snoring sound information such that an impact of the snoring sound is determined based on the snoring sound information, and causes the low frequency sound generating device to apply the low frequency sound to the subject when the impact is higher than a threshold.

According to another aspect of the present invention, an anti-snoring apparatus includes a first sound generator-canceller that applies a first low frequency sound to a first subject, a second sound generator-canceller that applies a second low frequency sound to a second subject next to the first subject, and a controller including circuitry which detects whether the first or second subject produces snoring sound, converts the snoring sound to a received signal, obtains snoring sound information from the received signal, processes the snoring sound information such that an impact of the snoring sound is determined based on the snoring sound information, causes one of the first and second sound generator-cancellers to apply the first or second low frequency sound to the first or second subject when the impact is higher than a threshold, and causes the other of the first and second sound generator-canceller to apply the first or second low frequency sound that suppresses the impact of the snoring sound.

According to still another aspect of the present invention, an anti-snoring apparatus includes a stimulation device that applies a stimulation to a first subject producing a snoring sound, a noise-canceling device that applies to a second subject next to the first subject a sound that cancels the snoring sound, and a controller including circuitry which converts the snoring sound to a received signal, obtains snoring sound information from the received signal, processes the snoring sound information such that an impact of the snoring sound is determined based on the snoring sound information, causes the stimulation device to apply the stimulation to the first subject when the impact is higher than a threshold, and causes the noise-canceling device to apply to the second subject the sound that cancels the snoring sound.

According to yet another aspect of the present invention, an anti-snoring method includes converting a snoring sound produced by a subject to a received signal, obtaining snoring sound information from the received signal, processing the snoring sound information such that an impact of the snoring sound is determined based on the snoring sound information, and applying a low frequency sound to the subject when the impact is higher than a threshold.

According to yet another aspect of the present invention, an anti-snoring method includes detecting whether a first subject or a second subject next to the first subject produces snoring sound, converting the snoring sound to a received signal, obtaining snoring sound information from the received signal, processing the snoring sound information such that an impact of the snoring sound is determined based on the snoring sound information, applying a first low frequency sound or a second low frequency sound to the first or second subject when the impact is higher than a threshold, and applying the first or second low frequency sound that suppresses the impact of the snoring sound.

According to yet another aspect of the present invention, an anti-snoring method includes converting a snoring sound to a received signal, obtaining snoring sound information from the received signal, processing the snoring sound information such that an impact of the snoring sound is determined based on the snoring sound information, applying a stimulation to a first subject when the impact is higher than a threshold, and applying to a second subject next to the first subject a sound that cancels the snoring sound.

According to yet another aspect of the present invention, a non-transitory computer readable medium having stored thereon a program that when executed by a computer, causes the computer to execute an anti-snoring method includes converting a snoring sound produced by a subject to a received signal, obtaining snoring sound information from the received signal, processing the snoring sound information such that an impact of the snoring sound is determined based on the snoring sound information, and applying a low frequency sound to the subject when the impact is higher than a threshold.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
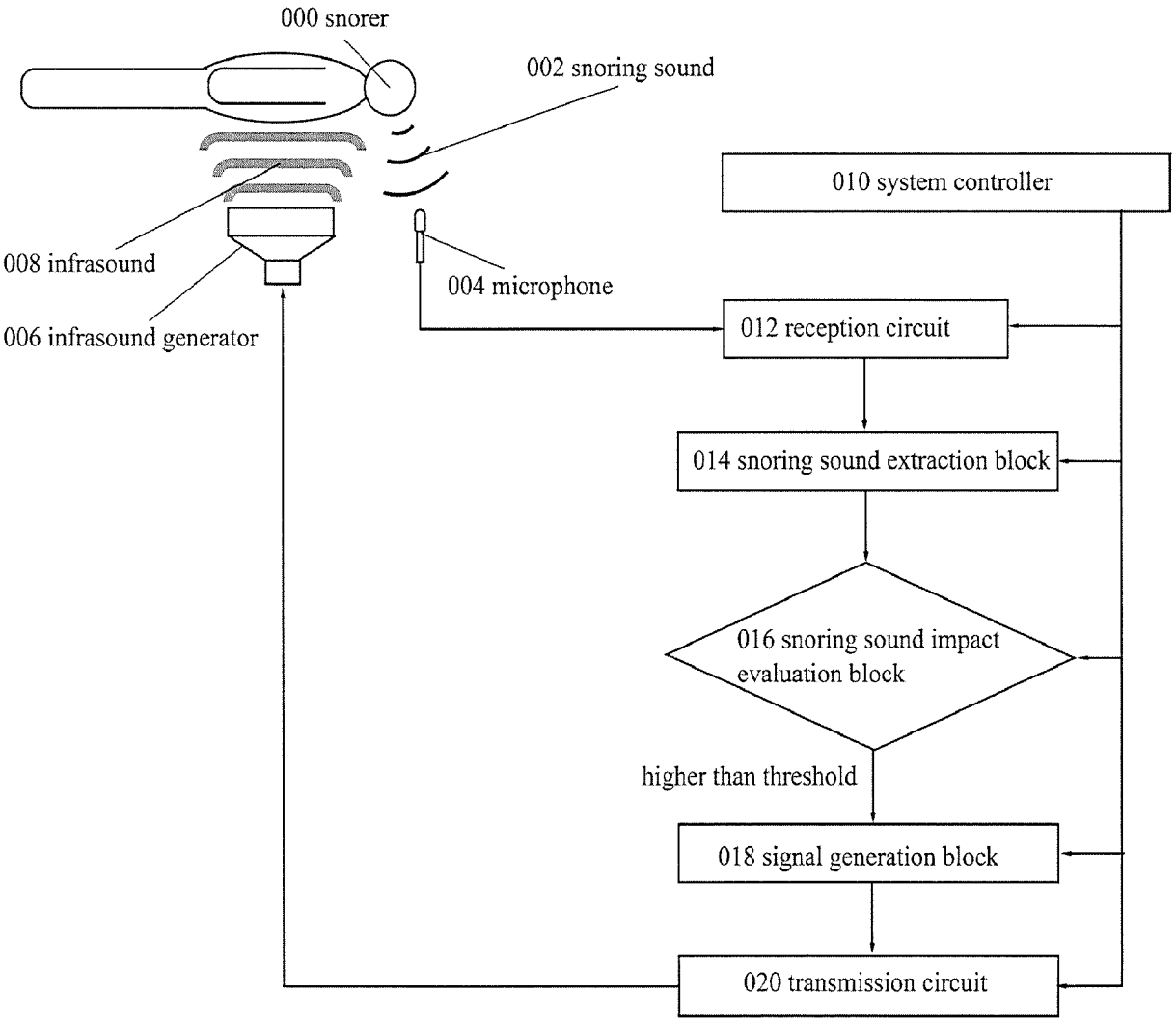
FIG. 1 is a schematic diagram of an anti-snoring apparatus using infrasound that is radiated to a subject.

The embodiments will now be described with reference to the accompanying drawings, wherein like reference numerals designate corresponding or identical elements throughout the various drawings.

Anti-snoring apparatus using infrasound according to an embodiment of the present invention includes an apparatus that detects snoring sound 002 of a snorer 000 and radiates infrasound 008 to a snorer 000. FIG. 1 shows a schematic diagram of an anti-snoring apparatus employing an embodiment of the present invention. The apparatus is provided with one or plural microphones 004, one or plural reception circuit 012, a snoring sound extraction block 014, a snoring sound impact evaluation block 016, a signal generation block 018, one or plural transmission circuits 020, one or plural infrasound generators 006, and a system controller 010.

A microphone 004 with a reception circuit 012 converts plural sounds produced by a subject to plural received signals. A microphone with a reception circuit in a cell phone is also applicable for the acquisition of plural received signals. A snoring sound extraction block 014 extracts snoring sound information from plural received signals. A snoring sound impact evaluation block 016 evaluates the impact of snoring sound comparing with a threshold. Specifically, it is determined whether the sound pressure at the microphone position exceeds a certain threshold value. The threshold value is a constant or a variable. A signal generation block 018 generates signals to produce infrasound 008 using an infrasound generator 006; and an infrasound generator 006 with a transmission circuit 018 that radiates infrasound 008 to a snorer 000.

Figure 12:
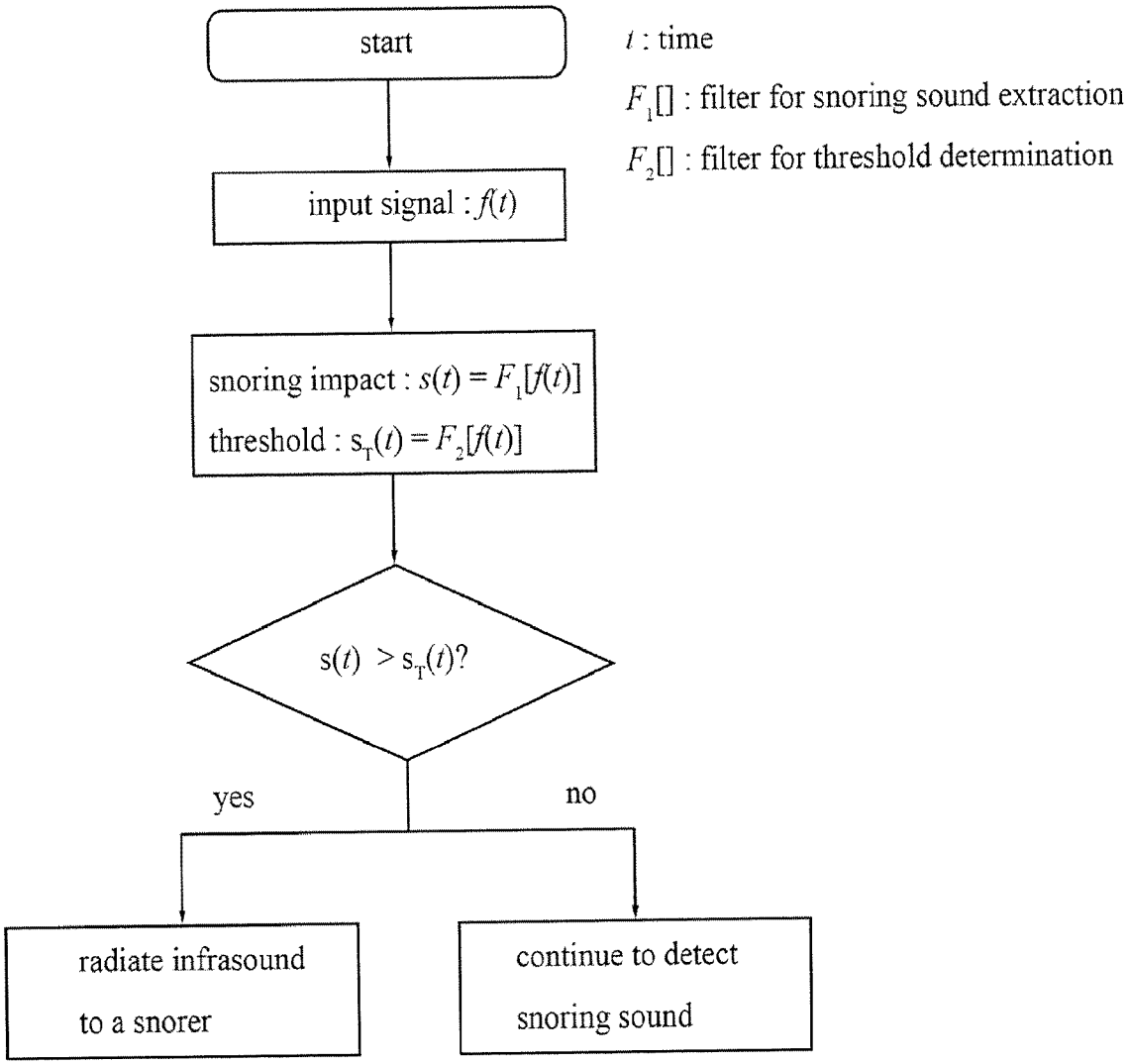
FIG. 12 is an algorithm of an anti-snoring apparatus according to an embodiment of the present invention.

The processes described above are controlled by the system controller 010 in the anti-snoring apparatus, and FIG. 12 shows an algorithm of the anti-snoring apparatus. The system controller 010 controls the microphone 004 to start receiving sounds produced by the subject and detect snoring sound. The system controller 010 controls such that the snoring sound detected is converted to a signal, snoring sound information is obtained from the signal, and the snoring sound information is processed to determine the impact (sound pressure) of the snoring sound based on the snoring sound information. When the system controller 010 determines that the impact of the snoring sound is higher than a threshold, the system controller 010 generates and sends a signal controlling the infrasound generator 006 such that infrasound 003 is generated and radiated to the snorer 000. When the system controller 010 determines that the impact of the snoring sound does not exceed the threshold, the system controller 010 generates and sends a signal controlling the microphone 004 to continue detecting snoring sound. The sound pressure of the infrasound 008 is set to a desired value so that the application of the infrasound 008 can suppress snore effectively under the constraint of unawareness of the infrasound radiation. Also, the sound pressure may be variable and adjustable according to individual differences in sensitivity to infrasound. Low frequency sound using a low frequency sound generator can be used as a substitute for infrasound 008 using an infrasound generator 006. The system controller 010 may be programed to change the order of functions and/or add more functions.

Figure 2:
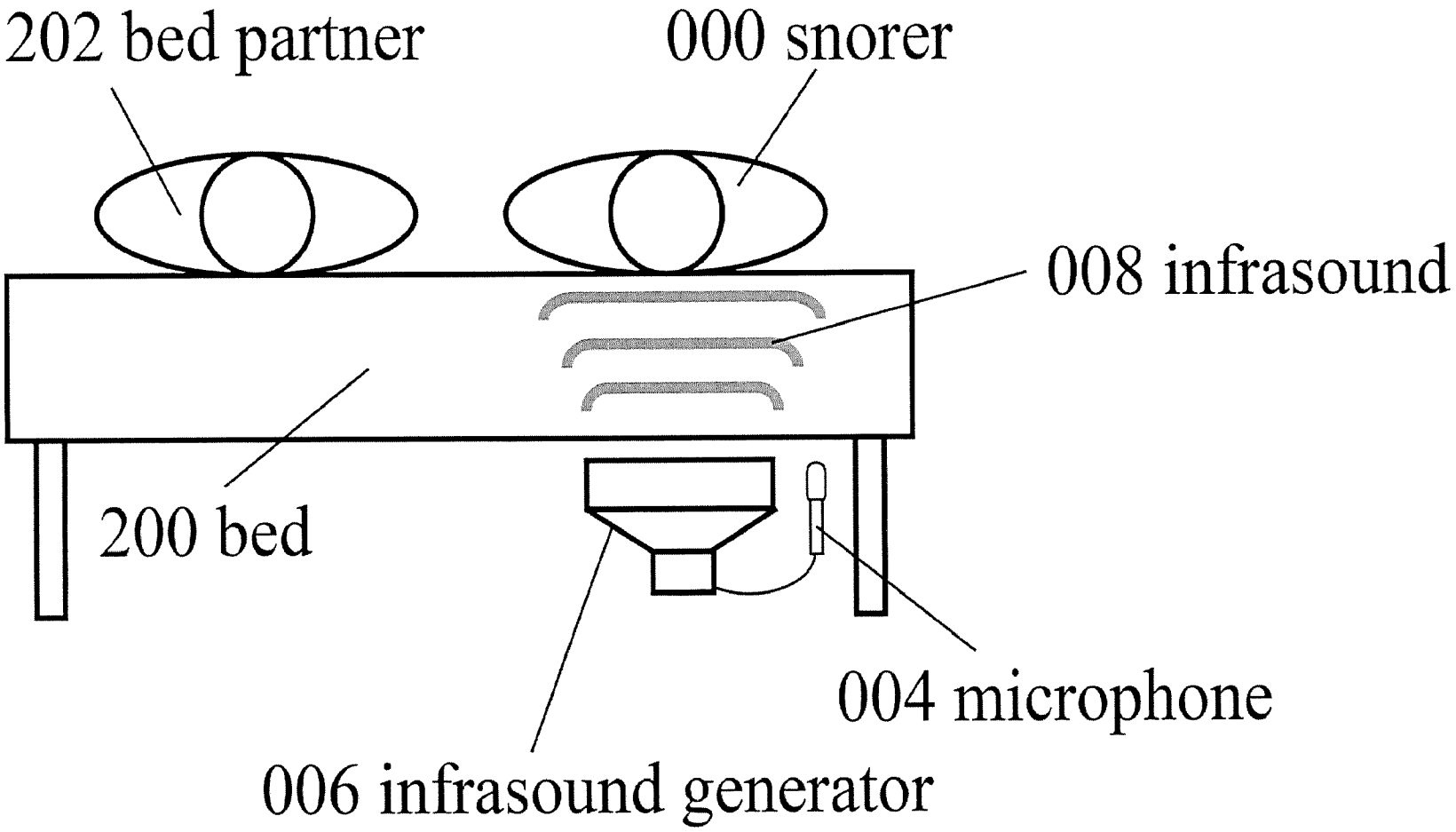
FIG. 2 is a schematic diagram of an anti-snoring apparatus that is installed at the space below the bed just under a snorer.

An infrasound generator 006 is located close to a snorer 000 in order to stimulate a snorer effectively by infrasound radiation. FIG. 2 shows an arrangement of an anti-snoring apparatus that employs an embodiment of the present invention. The infrasound generator 006 positioned below the bed just under a snorer 000 can stimulate a snorer 000 by infrasound 008 effectively and selectively, because infrasound 008 has high penetration and the distance from an infrasound generator 006 to a snorer 000 is much shorter than that to a bed partner 202.

A microphone 004 is located close to the mouth of a snorer 000 in order to collect sounds produced by a snorer 000 effectively. When an anti-snoring apparatus is standalone and it is installed below the bed just under a snorer 000, a microphone 004 is also located just under a snorer 000. When an anti-snoring apparatus employs a microphone with a reception circuit in a cell phone, it is suitable to locate a cell phone at the bedside of a snorer 000.

A snoring sound extraction block 014 extracts snoring sound information from plural received signals, and a snoring sound impact evaluation block 016 evaluates the impact of snoring sound. There are several techniques that extract and detect snoring sound (NPL 8). An anti-snoring apparatus according to an embodiment of the present invention can employ one or combination of snoring sound detection techniques.

A signal generation block 018 generates signals to produce infrasound 008 using an infrasound generator 006. The frequency of infrasound is lower than 20 Hz. In order to suppress the impact of infrasound radiation on a bed partner 202, it is suitable to radiate infrasound, or low frequency sound of 100 Hz or less.

An infrasound generator 006 with a transmission circuit 020 radiates infrasound 008 to a snorer 000 when a snoring sound is detected. Infrasound 008 stimulates a snorer 000 so that a snorer 000 stops snoring. There are several types of infrasound generators, e.g., subwoofer, fan, and vibrating board, or a combination thereof. An infrasound generator can radiate several types of infrasound, e.g., continuous sinusoidal wave, pulse wave, and impulse wave. A fan also generates air flow that eliminates damp at the space below the bed 200.

Figure 4:
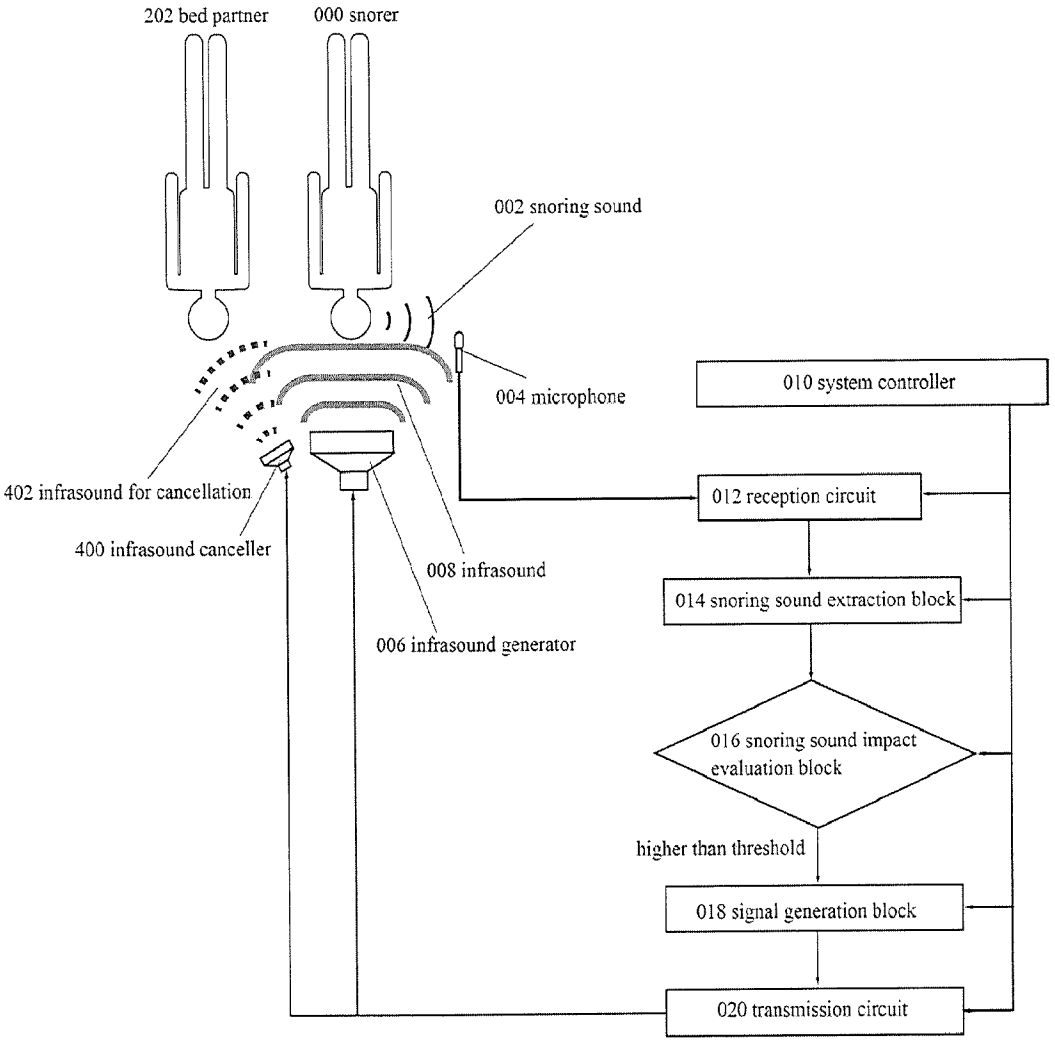
FIG. 4 is a schematic diagram of an anti-snoring apparatus using an infrasound generator that radiates infrasound to a subject and an infrasound canceller that radiates infrasound in order to suppress the impact of infrasound to a bed partner.

FIG. 4 is a schematic diagram of an anti-snoring apparatus that employs an infrasound canceller 400 in order to suppress the impact of infrasound radiation to a bed partner 202. A microphone 004 with a reception circuit 012 converts plural sounds produced by a subject to plural received signals. A microphone with a reception circuit in a cell phone is also applicable for the acquisition of plural received signals. A snoring sound extraction block 014 extracts snoring sound information from plural received signals. A snoring sound impact evaluation block 016 evaluates the impact of snoring sound. A signal generation block 018 generates signals to produce infrasound 008 using an infrasound generator 006. An infrasound generator 006 with a transmission circuit 018 radiates infrasound 008 to a snorer 000. A low frequency sound generator can be used as a substitute for an infrasound generator 006. A signal generation block 018 also generates signals to produce infrasound for cancellation 402 using an infrasound canceller 400. An infrasound canceller 400 with a transmission circuit 018 radiates infrasound for cancellation 402 in order to suppress the impact of infrasound to a bed partner 202. A low frequency sound canceller can be used as a substitute for an infrasound canceller 400.

Figure 5:
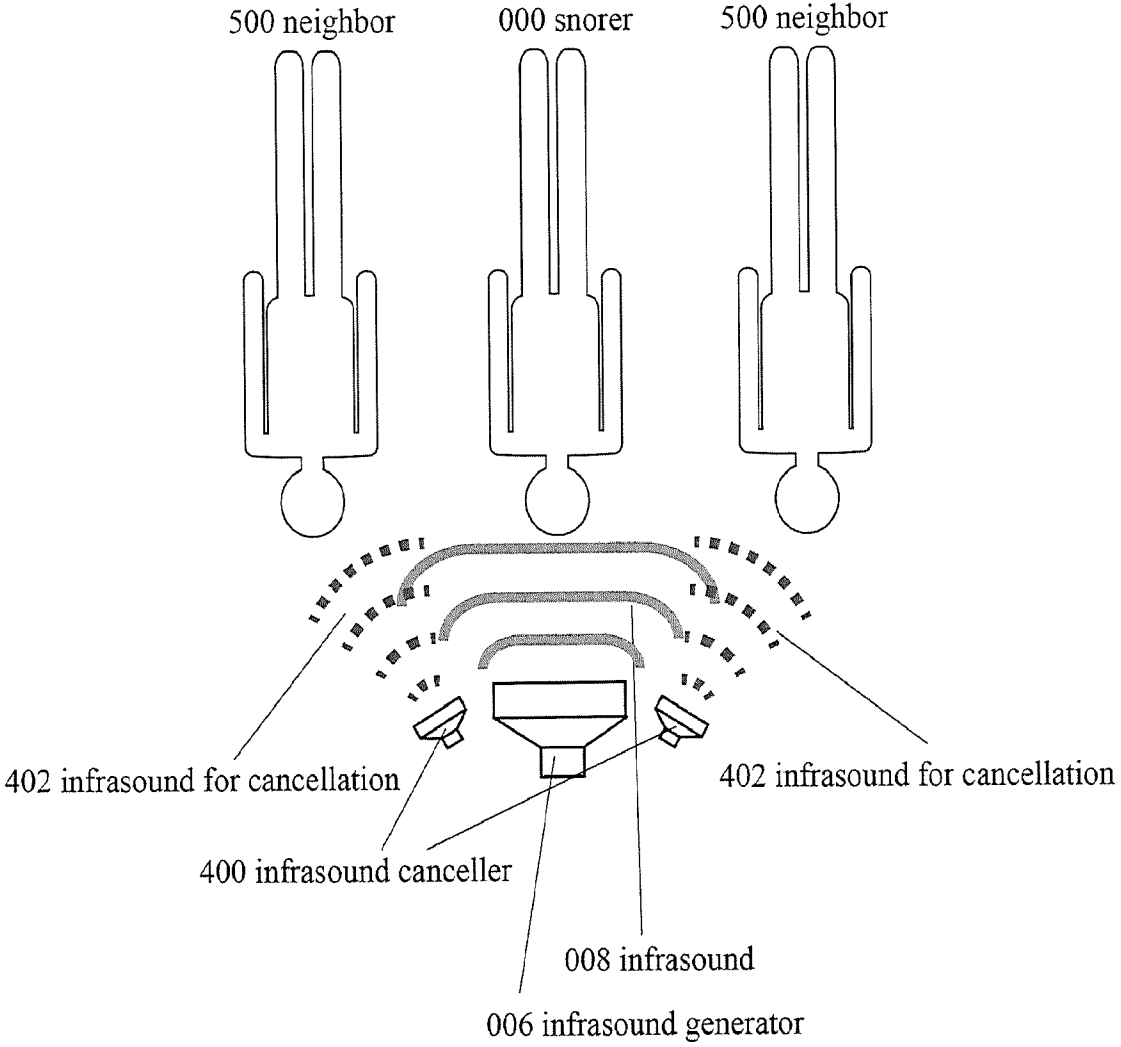
FIG. 5 is a schematic diagram of an anti-snoring apparatus that employs plural infrasound cancellers in order to suppress the impact of infrasound to neighbors effectively.

FIG. 5 shows an arrangement of an anti-snoring apparatus according to an embodiment of the present invention. Here, neighbors 500 sleep on both sides of a snorer 000. The use of two or more infrasound cancellers 400 can suppress the impact of infrasound to neighbors 500 effectively, because the two or more infrasound cancellers 400 radiate infrasound for cancellation 402 to both neighbors 500 effectively and selectively.

Figure 6:
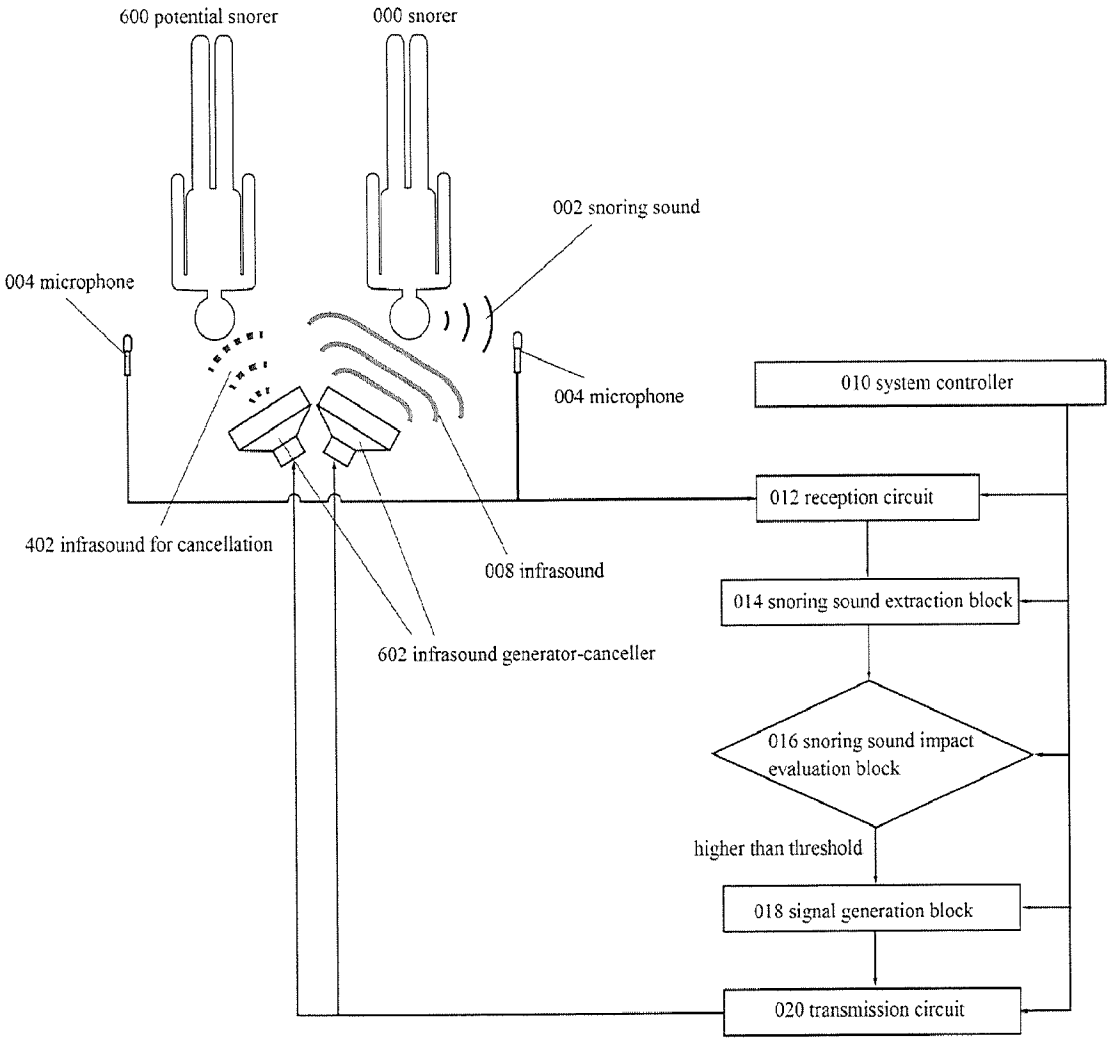
FIG. 6 is a schematic diagram of an anti-snoring apparatus that employs plural infrasound generator-cancellers in order to target one of snores for infrasound stimulation selectively when the one snores.

FIG. 6 shows an arrangement of an anti-snoring apparatus according to an embodiment of the present invention applicable to two snorers. The two or more infrasound generator-cancellers 602 can target one of them for infrasound stimulation selectively when the one snores, because this arrangement can switch the infrasound generator and the infrasound canceller freely by means of switching the signals generated at signal generation block 018.

Figure 13:
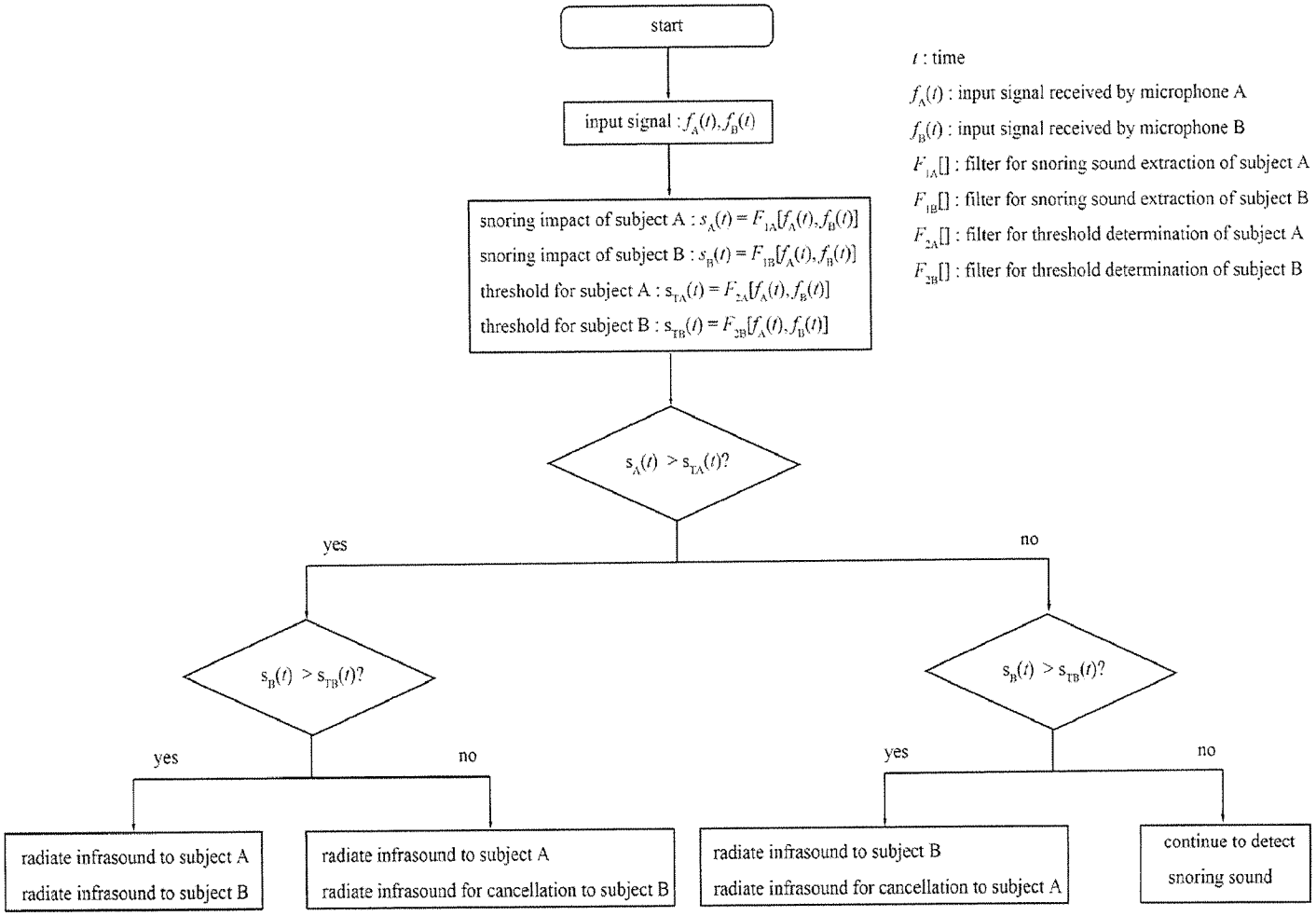
FIG. 13 shows an algorithm of an anti-snoring apparatus according to an embodiment of the present invention that employs plural infrasound generator-cancellers in order to target one of snores for infrasound stimulation selectively when the one snores.

An exemplary algorithm of the anti-snoring apparatus is shown in FIG. 13. Specifically, the system controller 010 controls the microphones 004 to start receiving sounds produced by subjects A and B and detect snoring sound from each subject. The system controller 010 controls such that the snoring sound detected is converted to a signal, snoring sound information is obtained from the signal, and the snoring sound information is processed to determine the impact (sound pressure) of the snoring sound based on the snoring sound information. When the system controller 010 determines that the impact of the snoring sound of subject A is higher than a threshold for the subject A, the system controller 010 then determines whether the impact of the snoring sound of subject B is higher than a threshold for the subject B. When the impact exceeds the threshold for the subject B, the system controller 010 generates and sends a signal controlling the infrasound generator—cancellers 602 such that infrasound 008 is generated and radiated to each of the subjects A and B. If the impact exceeds the threshold for the subject A, but not for the subject B, then the system controller 010 generates and sends a signal controlling the infrasound generator—cancellers 602 such that infrasound 008 is generated and radiated to the subject A and that the infrasound for cancellation 402 is generated and radiated to the subject B. When the system controller 010 determines that the impact of the snoring sound does not exceed the threshold for A, the system controller 010 then determines whether the impact of the snoring sound of subject B is higher than a threshold for the subject B. When the impact exceeds the threshold for the subject B, but not for the subject A, then the system controller 010 generates and sends a signal controlling the infrasound generator—cancellers 602 such that infrasound 008 is generated and radiated to the subject B and that the infrasound for cancellation 402 is generated and radiated to the subject A. If the impacts do not exceed the thresholds for the subjects A and B, then the system controller 010 generates and sends a signal controlling the microphones 004 to continue detecting snoring sound of the subjects A and B. The sound pressure of the infrasound 008 is set to a desired value so that the application of the infrasound 008 can suppress snore effectively under the constraint of unawareness of the infrasound radiation. Also, the sound pressure may be variable and adjustable according to individual differences in sensitivity to infrasound. Low frequency sound using a low frequency sound generator—canceller can be used as a substitute for infrasound 008. The system controller 010 may be programed to change the order of functions and/or add more functions.

Figure 7:
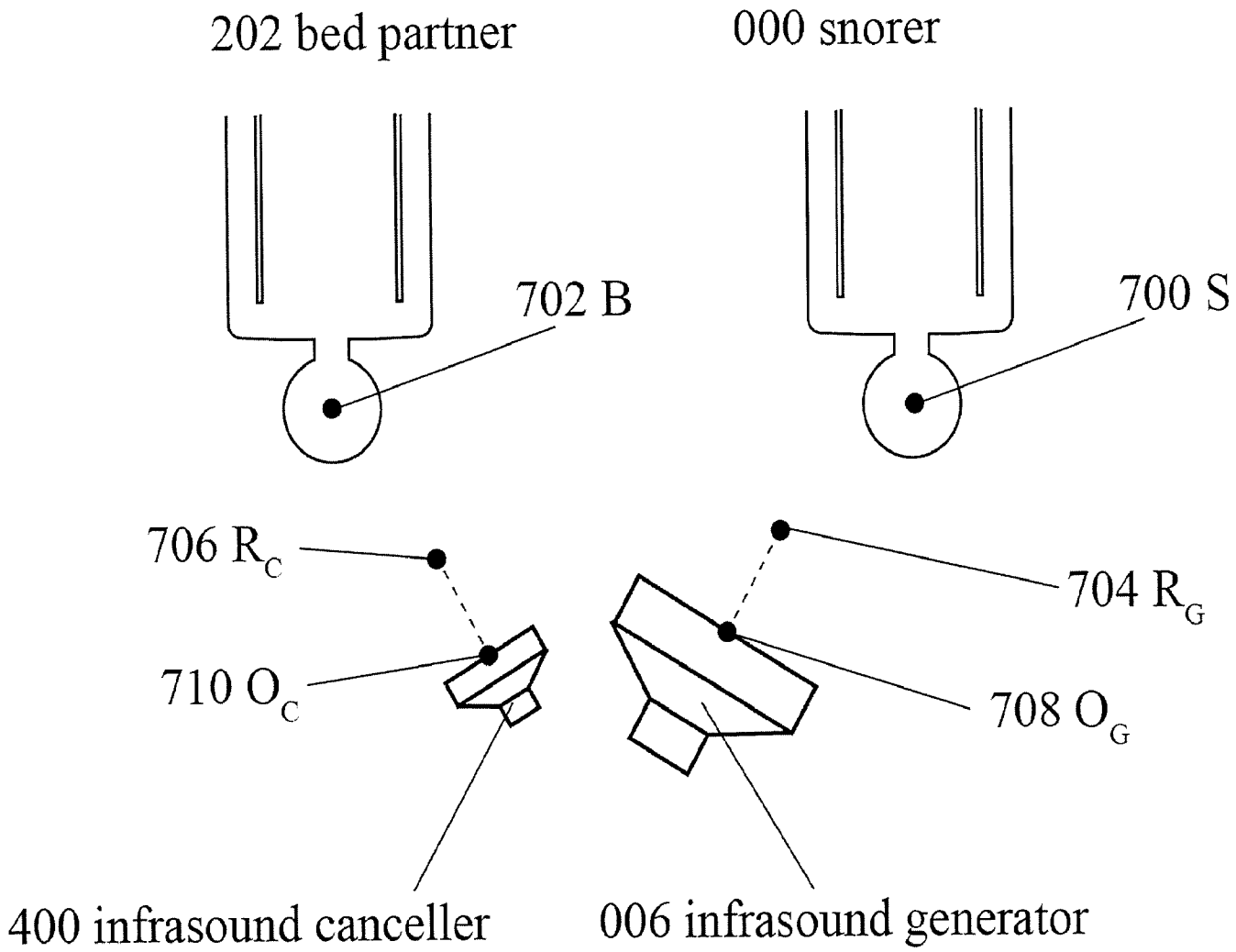
FIG. 7 is a schematic illustration of locations of a snorer, a bed partner, an infrasound generator and an infrasound canceller.

An infrasound canceller 400 radiates infrasound for cancellation 402 in order to cancel the impact of infrasound 008 to a bed partner 202. The sound pressure as the impact to a bed partner 202 caused by infrasound 008 and infrasound for cancellation 402 is given by the following formulae:

$$I_B(f) \propto \sqrt{A_G(f)B_G(r_G, \angle R_G O_G B, f)}\exp(j\omega t - jkr_G) + \sqrt{A_C(f)B_C(r_C, \angle R_C O_C B, f)}\exp\{j\omega t - jkr_C + j\phi(f)\}, \quad (1)$$

where $A_G(f)$ and $A_C(f)$ are respectively signal intensity of infrasound generator 006 and infrasound canceller 400 at the frequency f, $B_G(r, \theta, f)$ and $B_C(r, \theta, f)$ are respectively beam patterns of infrasound generator 006 and infrasound canceller 400 at the location of the distance r and the direction from the center θ at the frequency f, $R_G$ 704 and $R_C$ 706 are respectively on the center axes of infrasound generator 006 and infrasound canceller 400 (see FIG. 7), $O_G$ 708 and $O_C$ 710 are respectively on the origins of infrasound generator 006 and infrasound canceller 022, B 702 is the stimulation point of a bed partner 202, $\omega=2\pi f$ is the angular frequency, $k=2\pi/\lambda$ is the angular wavenumber and λ is the sound wavelength at the frequency off, the $r_G$ and $r_C$ are respectively the distance between B 702 and $O_G$ 708 and that between B 702 and $O_C$ 710, and φ(f) is the phase rotation at the frequency f. For the effective cancellation, φ(f) satisfies the following formulae:

$$\phi(f) = k(r_C - r_G) + (2n+1)\pi, \quad (2)$$

where n is an integer. The difference between $r_G$ and $r_C$ is, for example, 0.3 m or less, and the sound wavelength of a 100 Hz frequency or less is about 3.4 m or more. Therefore, in many cases the cancellation works when φ(f) satisfies the following formulae:

$$\phi(f) \approx (2n+1)\pi, \quad (3)$$

In order to sufficiently suppress the impact of infrasound to bed partner, the infrasound canceller radiates an infrasound for cancellation that satisfies the formulae (3) and the following formulae:

$$\sqrt{A_G(f)B_G(r_G, \angle R_G O_G B, f)} \approx \sqrt{A_C(f)B_C(r_C, \angle R_C O_C B, f)} \quad (4)$$

An anti-snoring apparatus can employ two or more infrasound cancellers 400, as shown in FIG. 5. In this case, the impact to a neighbor 500 caused by infrasound 008 and infrasound for cancellation 402 is given by the following formulae:

$$I_B(f) \propto \sqrt{A_G(f)B_G(r'_G, \angle R_G O_G N, f)}\exp(j\omega t - jkr'_G) + \sum_i \left[\sqrt{A_{Ci}(f)B_{Ci}(r_{Ci}, \angle R_{Ci} O_{Ci} N, f)}\exp\{j\omega t - jkr_{Ci} + j\varphi_i(f)\}\right], \quad (5)$$

where $A_{Ci}(f)$ is signal intensity of the i-th infrasound canceller 400 at the frequency f, $B_{Ci}(r, \theta, f)$ is beam pattern of the i-th infrasound canceller 400 at the location of the distance r and the direction from the center θ at the frequency f, $R_{Ci}$ is on the center axis of the i-th infrasound canceller 400. $\theta_{Ci}$ is on the origin of the i-th infrasound canceller 400, N is the stimulation point of a neighbor 500, the $r_G'$ and $r_{Ci}$ are respectively the distance between N and $O_G$ 708 and that between N and $O_{Ci}$, and $\phi_i(f)$ is the phase rotation for the i-th infrasound canceller 400 at the frequency f.

The infrasound canceller that faces a neighbor 500 has the major role in the suppression of the impact caused by infrasound 008 to the neighbor 500. That is, when the l-th infrasound canceller faces to the neighbor 500, the intensity of the beam pattern of the l-th infrasound canceller at the location of the neighbor 500 is much larger than those of other infrasound cancellers. Therefore, for the effective cancellation, the l-th infrasound canceller radiates an infrasound for cancellation that satisfies the following formulae:

$$\phi_i(f) = k(r_{Cl} - r_G') + 2n+1)\pi \approx (2n+1)\pi, \quad (6)$$

$$\sqrt{A_G(f)B_G(r_G', \angle R_G O_G N, f)} \approx \sqrt{A_{Cl}(f)B_{Cl}(r_{Cl}, \angle R_{Cl} O_{Cl} N, f)} \quad (7)$$

Figure 8:
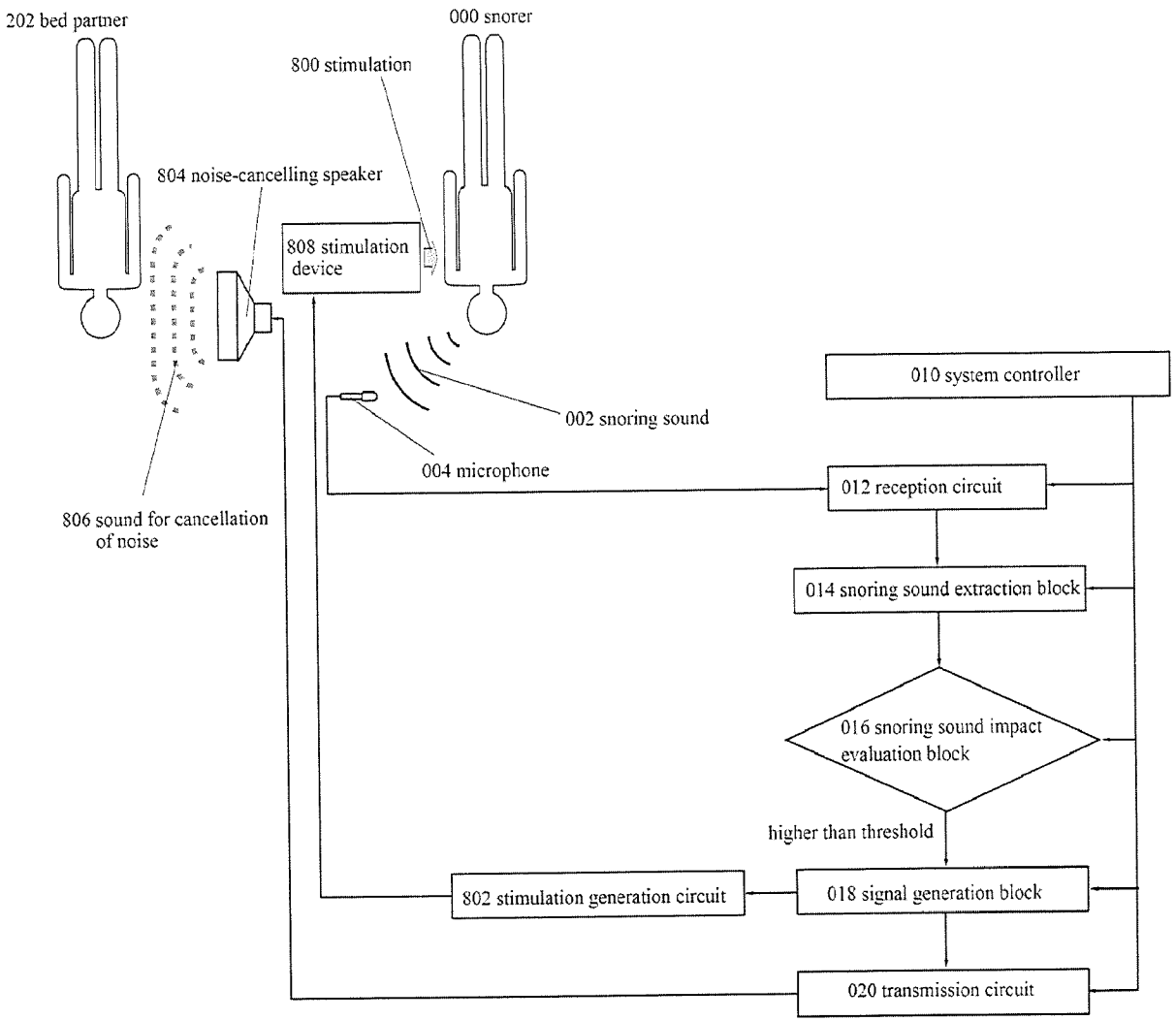
FIG. 8 is a schematic diagram of an anti-snoring apparatus using a noise-cancelling speaker that radiates sound for cancellation of noise to a bed partner and applies stimulation to a snorer.

FIG. 8 shows an arrangement of an anti-snoring apparatus according to an embodiment of the present invention, employing noise-cancelling technique. A microphone 004 with a reception circuit 012 converts plural sounds produced by a subject to plural received signals. A microphone with a reception circuit in a cell phone is also applicable for the acquisition of plural received signals. A snoring sound extraction block 014 extracts snoring sound information from plural received signals. A snoring sound impact evaluation block 016 evaluates the impact of snoring sound. A signal generation block 018 generates two kinds of signals in order to produce sound for cancellation of noise 806 using a noise-cancelling speaker 804 and to produce stimulation 800 applied to a snorer using a stimulation device 808. Noise 806 used in this application includes indoor noise from inside, e.g. snoring sound, operating sound of air conditioner, and environmental noise from outside, e.g. noise caused by transport, industrial and recreational activities. Stimulation 800 used in this application means an action of an agent or form of energy applied to receptors of human that generates action potential. A stimulation device 808 with a stimulation generation circuit 802 applies stimulation to a snorer when the snoring sound impact evaluation block 016 detects snoring sound. Low frequency sound including infrasound, ultrasound, audible sound, wind flow, light stimulation, thermal stimulation, and electrical stimulation can be used as stimulation 800 applied to a snorer. Ultrasound used in this application means sound waves with the frequencies of 20 kHz or higher. Audible sound used in this application means sound waves with the frequencies of from 20 Hz to 20 kHz. Wind flow used in this application means the flow of the air. Light stimulation used in this application means the change in brightness. Thermal stimulation used in this application is the stimulation applied using thermal change. Electrical stimulation used in this application is the stimulation applied using electrical current. A noise-cancelling speaker 804 with a transmission circuit 020 radiates sound for cancellation of noise 806 to a bed partner. Earphones or headphone can be used as a substitute for a noise-cancelling speaker 804.

Figure 9:
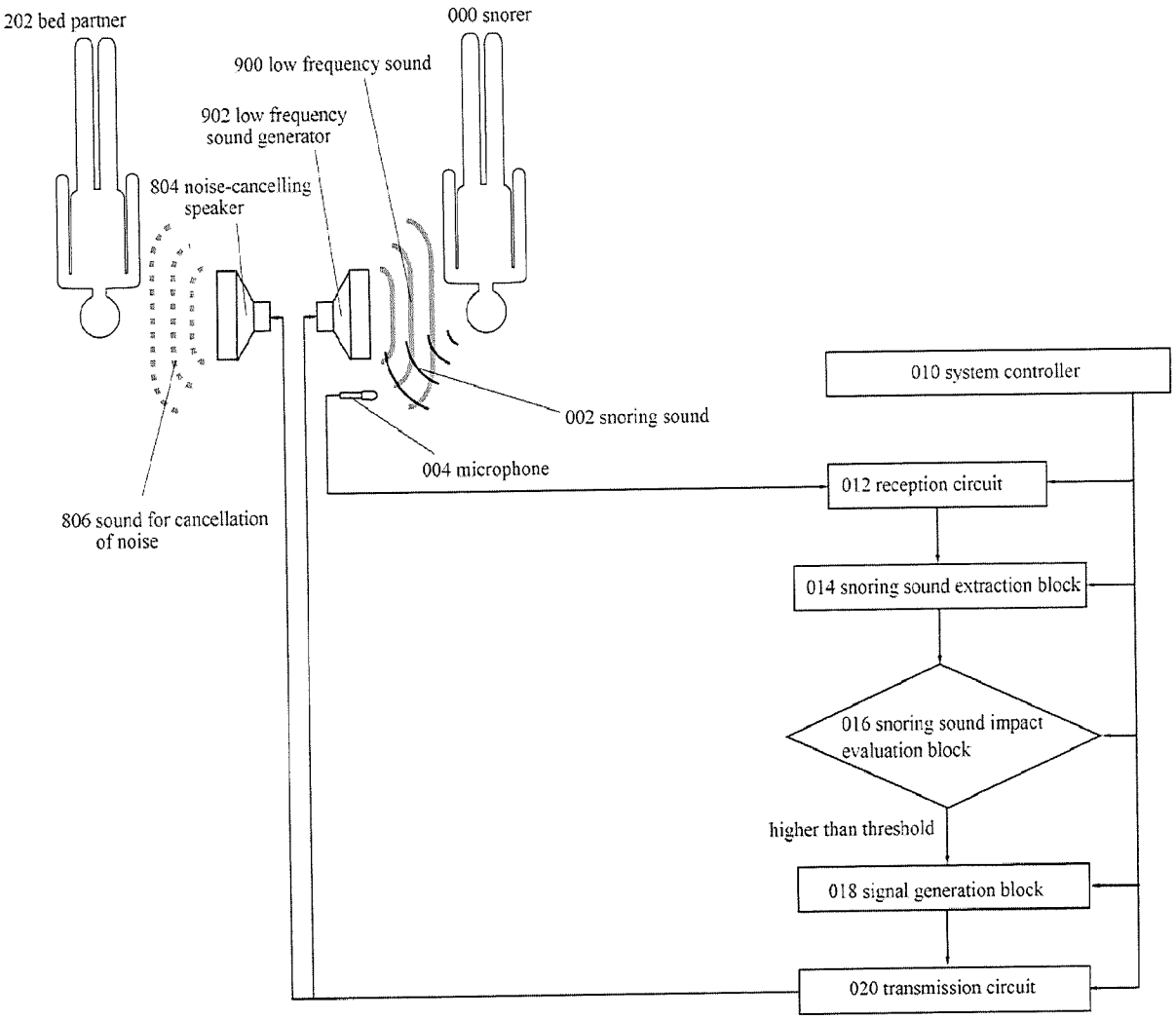
FIG. 9 is a schematic diagram of an anti-snoring apparatus using a noise-cancelling speaker and a low frequency sound generator in order to radiate sound for cancellation of noise to a bed partner and to radiate low frequency sound to a snorer for the suppression of snoring.

FIG. 9 shows an arrangement of an anti-snoring apparatus according to an embodiment of the present invention, using low frequency sound for stimulation to a snorer. A signal generation block 018 generates two kinds of signals in order to produce sound for cancellation of noise 806 using a noise-cancelling speaker 804 and to produce low frequency sound 900 using a low frequency sound generator 902. A low frequency sound generator 902 with a transmission circuit 020 radiates low frequency sound 900 to a snorer 000. A noise-cancelling speaker 804 with a transmission circuit 020 radiates sound for cancellation of noise 806 to a bed partner 202.

Figure 10:
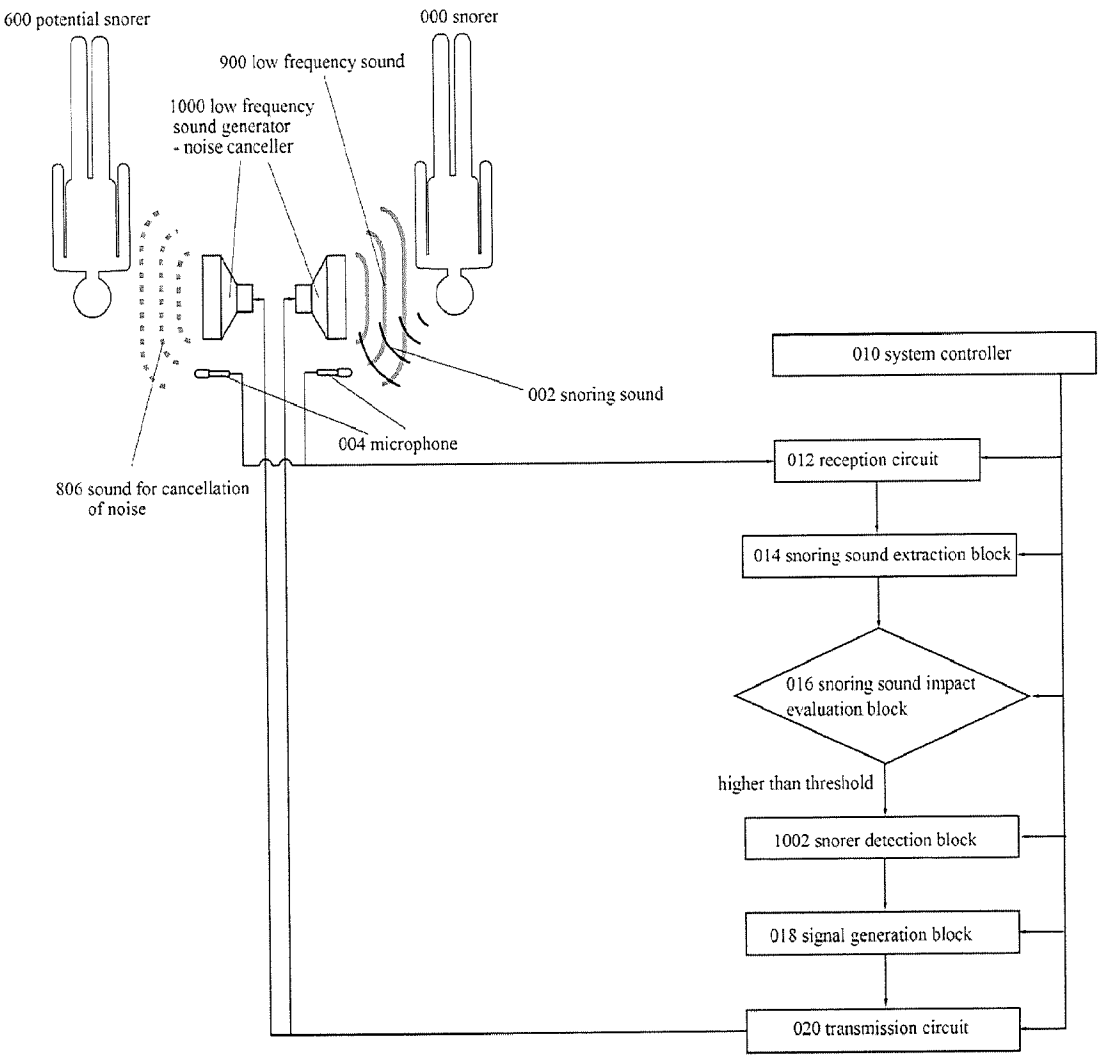
FIG. 10 is a schematic diagram of an anti-snoring apparatus that employs plural low frequency sound generator-noise cancellers in order to radiate low frequency sound to a snorer and to radiate sound for cancellation of noise to a potential snorer.

FIG. 10 shows an arrangement of an anti-snoring apparatus according to an embodiment of the present invention applicable to two snorers. A snorer detection block 1002 determines which is the snorer among sleepers using the received signals acquired by two or more microphones 004. The employment of two or more low-frequency sound generator-noise cancellers 1000 can apply low-frequency sound stimulation to the snorer selectively among sleepers, because this arrangement can switch the low frequency sound generator and the noise-cancelling speaker freely. The low frequency sound generator-noise canceller 1000 directed to the snorer radiates low frequency sound 900 to the snorer. The low frequency generator-noise canceller 1000 directed to a sleeper without snoring radiates sound for cancellation of noise 806 to the sleeper.

Figure 11:
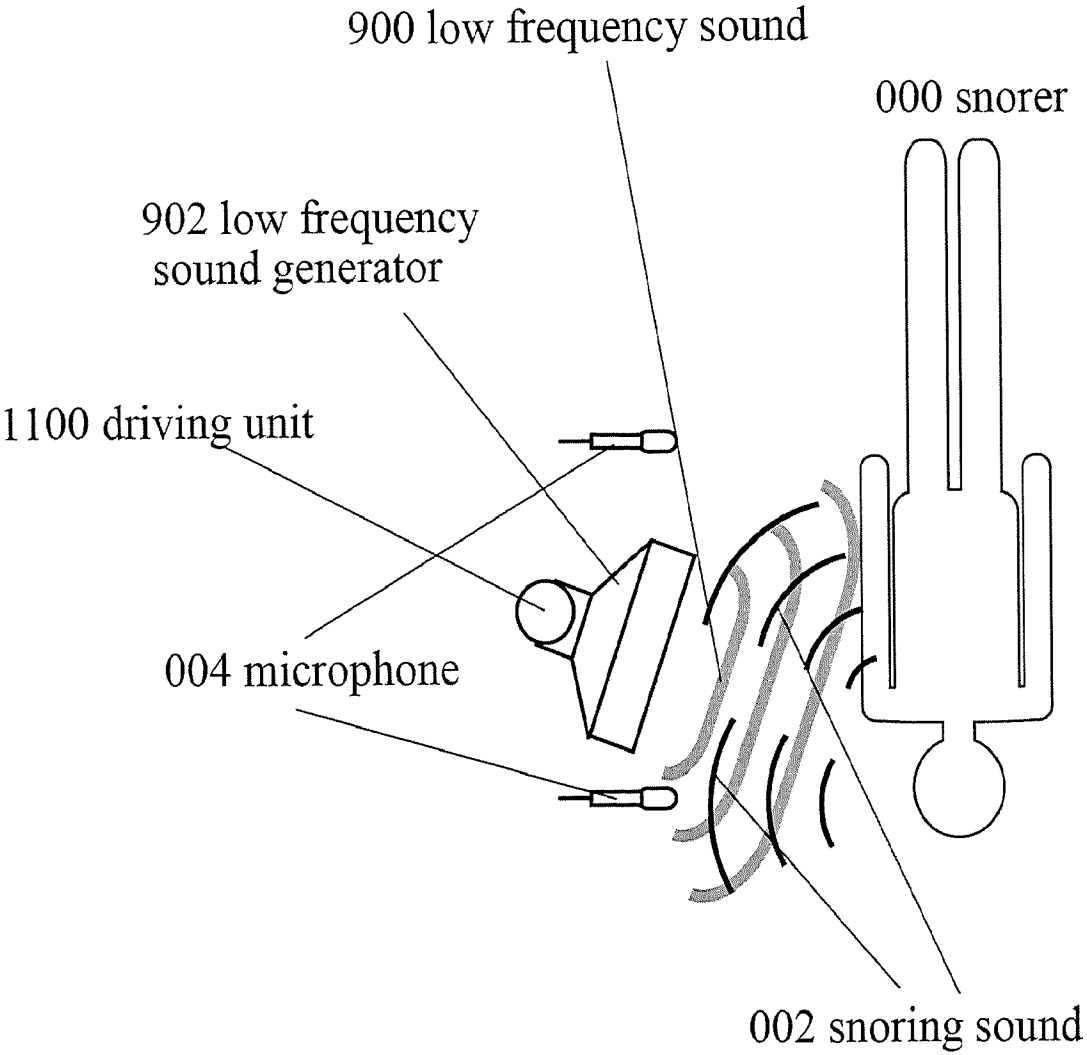
FIG. 11 is a schematic diagram of a low frequency sound generator with two microphones that radiates low frequency sound to the head of a snorer even when the head location changes.

FIG. 11 shows an arrangement of a low frequency sound generator 902 according to an embodiment of the present invention applicable to snorers who move while sleeping. Two or more microphones 004 are used for each sleeper in order to determine the direction of arrival of the snoring sound 002. Ultra-wide-band radar sensors, time-of-flight depth sensors including RF modulated optical beam distance sensors using phase detectors, range gated imagers, and direct time-of-flight imagers, can be used in order to determine the direct of arrival of the snoring sound 002. A driving unit 1100 directs the low frequency sound generator 902 to the direction of arrival of the snoring sound 002.

An anti-snoring method using sound for cancellation of noise is applicable to an anti-snoring device. This method employs one or plural microphones with one or plural reception circuits that convert plural sounds produced by a subject to plural received signals. The method carries out signal processing using one or more microprocessors that extracts snoring sound information from plural received signals. One or plural graphics processing units (GPU), one or plural field-programmable gate arrays (FPGA) are also applicable in order to carry out signal processing. The method carries out signal processing using one or more microprocessors that evaluates the impact of snoring sound. A signal generation circuit generates two kinds of signals in order to produce sound for cancellation of noise using a noise-cancelling speaker and to produce stimulation applied to a snorer using a stimulation device. A stimulation device with a stimulation generation circuit applies stimulation to a snorer. A noise-cancelling speaker with a transmission circuit radiates sound for cancellation of noise to a bed partner.

Figure 14:
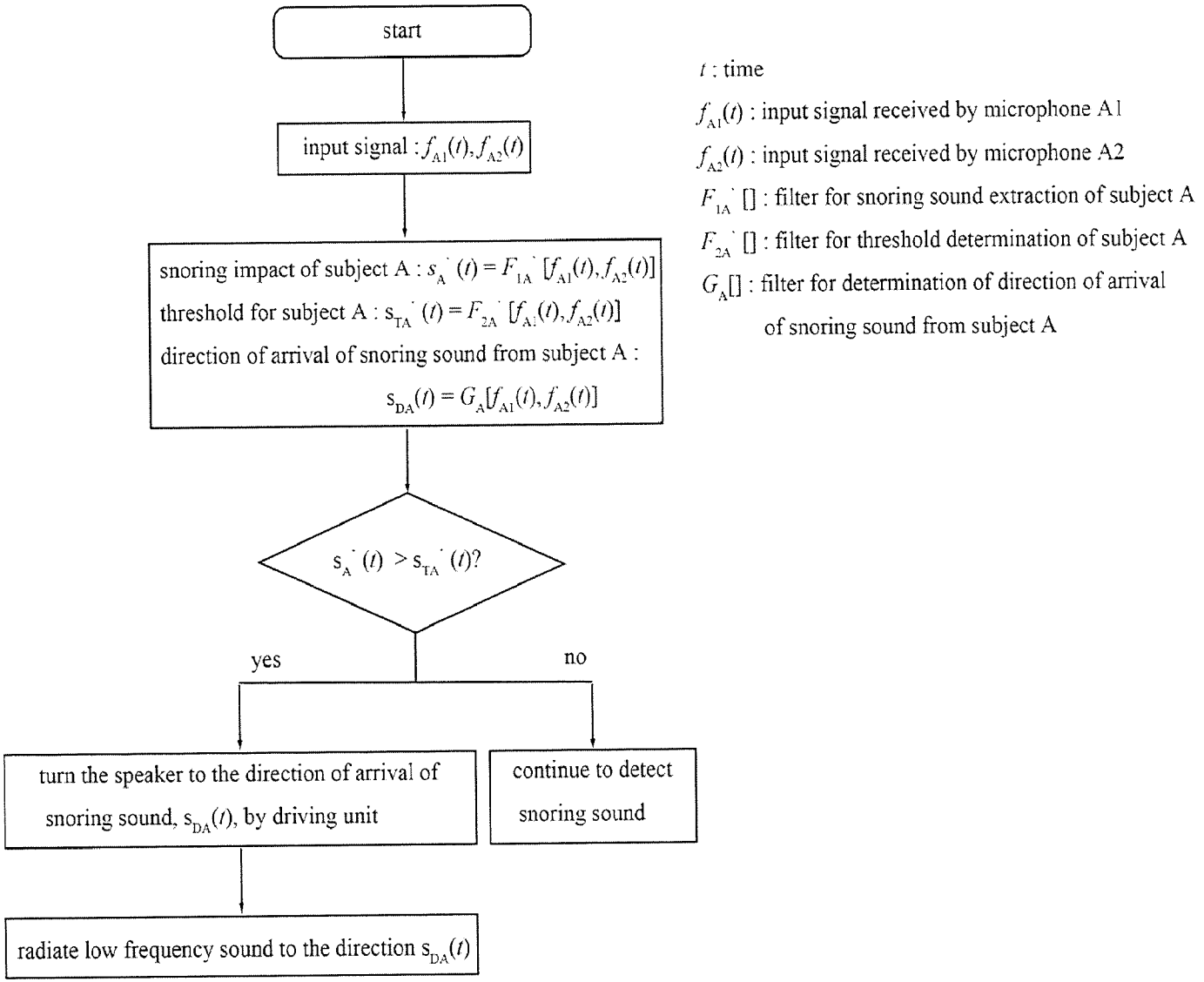
FIG. 14 shows an algorithm of an anti-snoring apparatus according to an embodiment of the present invention that employs a low frequency sound generator with two microphones which radiates low frequency sound to the head of a snorer even when the head location changes.
Figure 15:
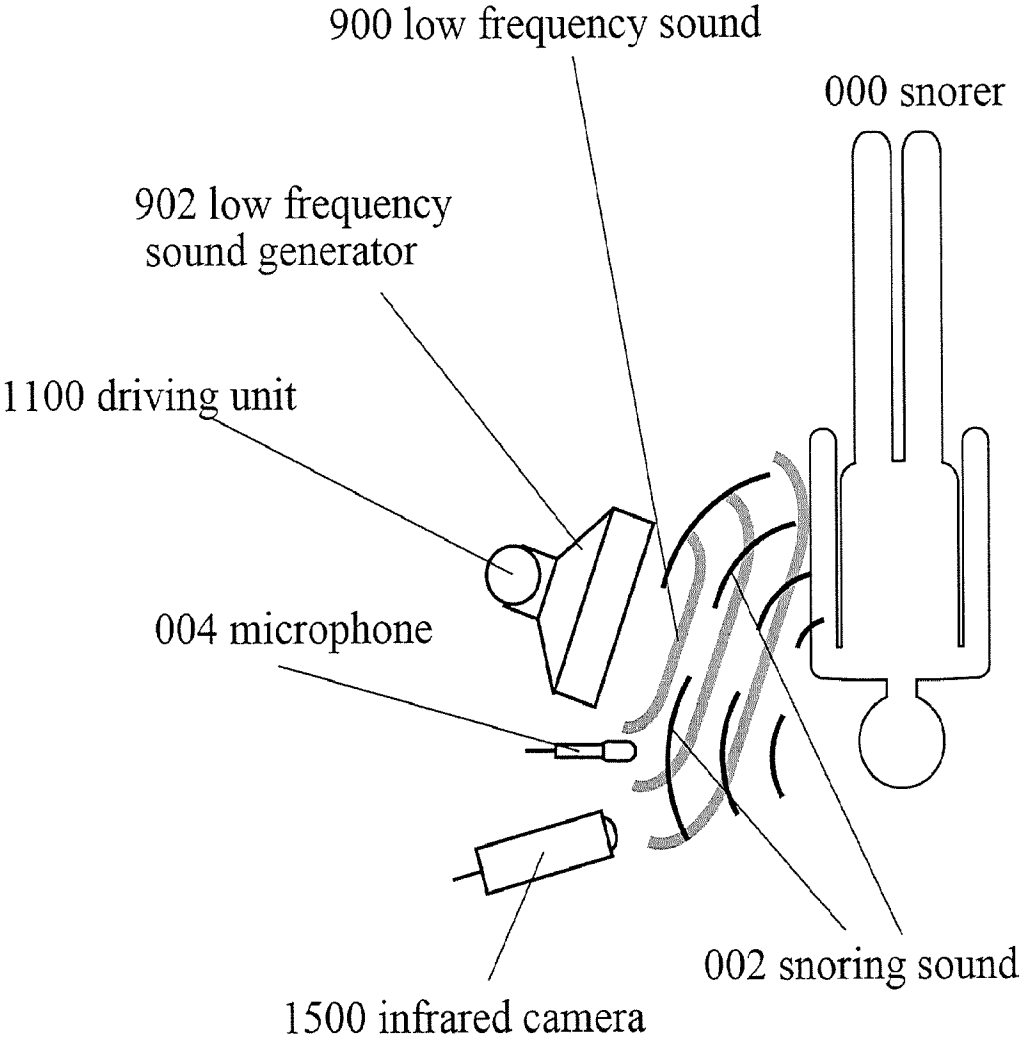
FIG. 15 shows a schematic diagram of a low frequency sound generator with a microphone and an infrared camera which radiates low frequency sound to the head of a snorer even when the head location changes.
Figure 16:
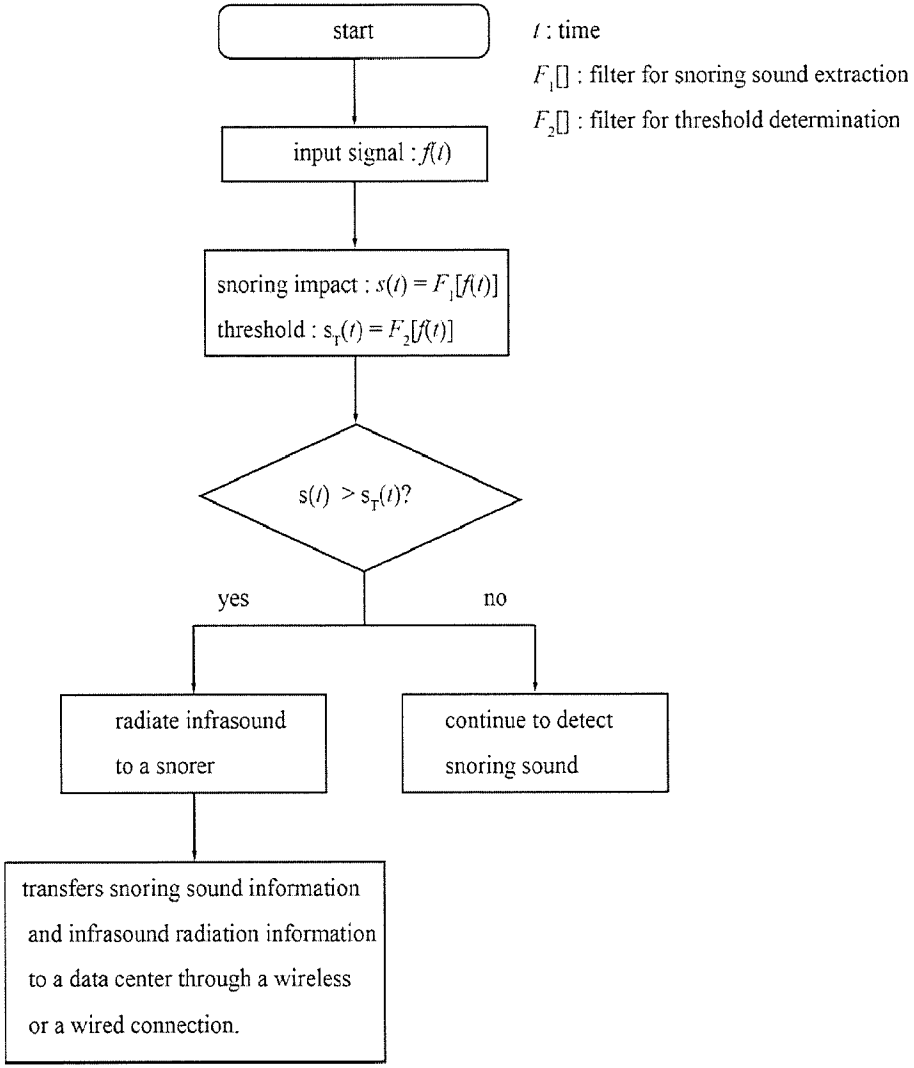
FIG. 16 shows an algorithm of an anti-snoring apparatus according to an embodiment of the present invention which transfers snoring sound information and infrasound radiation information to a data center through a wireless or a wired connection.

FIG. 12 shows an algorithm of an anti-snoring apparatus according to an embodiment of the present invention. FIG. 13 shows an algorithm of an anti-snoring apparatus according to an embodiment of the present invention that employs plural infrasound generator-cancellers in order to target one of snores for infrasound stimulation selectively when the one snores. FIG. 14 shows an algorithm of an anti-snoring apparatus according to an embodiment of the present invention that employs a low frequency sound generator with two microphones which radiates low frequency sound to the head of a snorer even when the head location changes. FIG. 15 shows a schematic diagram of a low frequency sound generator with a microphone and an infrared camera which radiates low frequency sound to the head of a snorer even when the head location changes. FIG. 16 shows an algorithm of an anti-snoring apparatus according to an embodiment of the present invention that transfers snoring sound information and infrasound radiation information to a data center through a wireless or a wired connection.

First Exemplary Embodiment

FIG. 2 shows an arrangement of an anti-snoring apparatus that employs an embodiment of the present invention. An anti-snoring apparatus is installed at the space below the bed just under a snorer 000 to stimulate a snorer 000 by infrasound 008 effectively and selectively. An anti-snoring apparatus is stand-alone and a microphone 004 is also located just under a snorer 000 or at the bedside of a snorer 000.

Second Exemplary Embodiment

Figure 3:
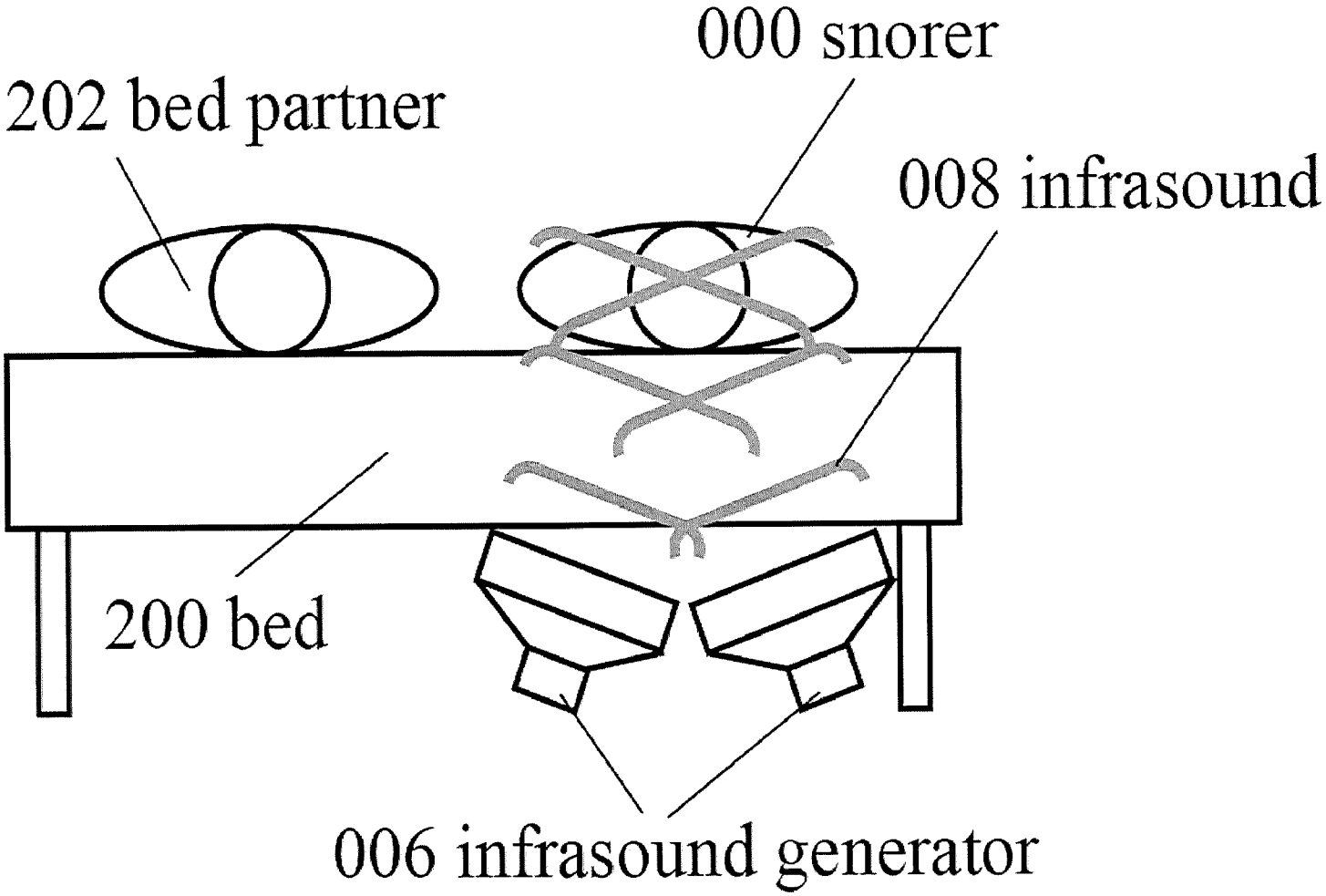
FIG. 3 is a schematic diagram of infrasound generators focused at a location of a subject body.

FIG. 3 shows an embodiment of an anti-snoring apparatus that employs plural infrasound generators 006 positioned close to one location of a snorer body, e.g., head, chest, or abdomen in order to enhance the stimulation effect on that location.

Third Exemplary Embodiment

An embodiment of the present invention is an anti-snoring apparatus that uses a cell phone. A snorer 000 produces plural sounds which are converted to plural received signals by a cell phone. A cell phone also extracts snoring sound information from plural received signals, and evaluates the impact of snoring sound. A cell phone generates signals and sends the signals to an infrasound generator with a transmission circuit through a wireless or a wired connection.

Fourth Exemplary Embodiment

An embodiment of the present invention is an anti-snoring apparatus that transfers snoring sound information and infrasound radiation information to a data center through a wireless or a wired connection (see FIG. 16). A data center analyzes the snoring sound and infrasound radiation information to provide a better snoring sound detection system and infrasound radiation process. The latest setting of the anti-snoring apparatus is updated through a wireless or a wired connection. The anti-snoring apparatus also transfers sound information, infrasound radiation information, and clinical advices assessed by the information acquired by the anti-snoring apparatus to a user and/or a third party, e.g., sleep clinic. This anti-snoring apparatus may employ a cell phone.

Fifth Exemplary Embodiment

FIG. 4 shows an anti-snoring apparatus that employs one or more microphones with one or more reception circuits that convert plural sounds produced by a subject to plural received signals. A snoring sound extraction block extracts snoring sound information from plural received signals. A snoring sound impact evaluation block evaluates the impact of snoring sound. A signal generation block generates signals to produce infrasound using an infrasound generator and infrasound for cancellation using an infrasound canceller. An infrasound generator with a transmission circuit radiates infrasound to a snorer. An infrasound canceller with a transmission circuit radiates infrasound for cancellation to a bed partner.

Sixth Exemplary Embodiment

FIG. 5 shows an arrangement of an anti-snoring apparatus that employs an embodiment of the present invention. The use of two or more infrasound cancellers 400 can suppress the impact of infrasound to neighbors 500 effectively, because the two or more infrasound cancellers 400 radiate infrasound for cancellation 402 to both neighbors 500 effectively and selectively.

Seventh Exemplary Embodiment

FIG. 6 shows an arrangement of an anti-snoring apparatus that employs an embodiment of the present invention. The two or more infrasound generator-cancellers 602 can target one of them for infrasound stimulation selectively when the one snores, because this arrangement can switch the infrasound generator and the infrasound canceller freely.

Eighth Exemplary Embodiment

FIG. 8 shows an anti-snoring apparatus that employs one or more microphones 004 with one or more reception circuits 012 that convert plural sounds produced by a subject to plural received signals. A snoring sound extraction block 014 extracts snoring sound information from plural received signals. A snoring sound impact evaluation block 016 evaluates the impact of snoring sound. A signal generation block 018 generates two kinds of signals in order to produce sound for cancellation of noise 806 using a noise-cancelling speaker 804 and to produce stimulation 800 applied to a snorer using a stimulation device 808. A stimulation device 808 with a stimulation generation circuit 802 applies stimulation to a snorer when the snoring sound impact evaluation block 016 detects snoring sound. Low frequency sound including infrasound, ultrasound, audible sound, wind flow, light stimulation, thermal stimulation, electrical stimulation can be used for the stimulation to a snorer. A noise-cancelling speaker 804 with a transmission circuit 020 radiates sound for cancellation of noise 806 to a bed partner.

Ninth Exemplary Embodiment

FIG. 9 shows an arrangement of an anti-snoring apparatus that employs an embodiment of the present invention. A signal generation block 018 generates two kinds of signals in order to produce sound for cancellation of noise 806 using a noise-cancelling speaker 804 and to produce low frequency sound 900 using a low frequency sound generator 902. A low frequency sound generator 902 with a transmission circuit 020 radiates low frequency sound 900 to a snorer 000. A noise-cancelling speaker 804 with a transmission circuit 020 radiates sound for cancellation of noise 806 to a bed partner 202.

Tenth Exemplary Embodiment

FIG. 10 shows an arrangement of an anti-snoring apparatus that employs an embodiment of the present invention. A snorer detection block 1002 determines which is the snorer among sleepers using the received signals acquired by two microphones 004. The use of two or more low-frequency sound generator—noise cancellers 1000 allows application of low-frequency sound stimulation to the snorer selectively among sleepers, and switching between the low frequency sound generator and the noise-cancelling speaker freely. The low frequency sound generator-noise canceller 1000 directed to the snorer radiates low frequency sound 900 to the snorer. The low frequency sound generator-noise canceller 1000 directed to a sleeper without snoring radiates sound for cancellation of noise 806 to the sleeper.

Eleventh Exemplary Embodiment

FIG. 11 shows s an arrangement of a low frequency sound generator 902 that employs an embodiment of the present invention. Two or more microphones 004 are used for each sleeper in order to determine the direction of arrival of the snoring sound 002. A driving unit directs the low frequency sound generator 902 to the direction of arrival of the snoring sound 002.

FIG. 14 shows an exemplary algorithm of the anti-snoring device. Specifically, the system controller 010 controls the microphones 004 (A1 and A2) to start receiving sounds produced by snorer 000 (subject A) and detect snoring sound. The system controller 010 controls such that the snoring sound detected is converted to a signal, snoring sound information is obtained from the signal, and the snoring sound information is processed to determine the impact (sound pressure) of the snoring sound based on the snoring sound information. When the system controller 010 determines that the impact of the snoring sound is higher than a threshold for the subject A, the system controller 010 then controls such that the direction of arrival of the snoring sound is determined, and the driving unit 1100 directs the low frequency sound generator 902 (e.g., speaker) to the direction of arrival of the snoring sound. The system controller 010 generates and sends a signal controlling the low frequency sound generator 902 such that low frequency sound 900 is generated and radiated in the direction determined. If the impact does not exceed the threshold for the subject A, then the system controller 010 generates and sends a signal controlling the microphones 004 to continue detecting snoring sound. The sound pressure of the low frequency sound 900 is set to a desired value so that the application of the low frequency sound 900 can suppress snore effectively under the constraint of unawareness of the infrasound radiation. Also, the sound pressure may be variable and adjustable according to individual differences in sensitivity to low frequency sound. The system controller 010 may be programed to change the order of functions and/or add more functions.

As addressed above, snoring sound is a large problem for the bed partner of a snorer. There are many attempts that suppress the impact of snoring sound; however, most of them require behavior change or invasive procedure.

To solve the above-mentioned problem, an aspect of the present invention is to provide an apparatus for suppression of snoring sound using low frequency sound. The anti-snoring apparatus according to an aspect of the present invention is an anti-snoring apparatus using low frequency sound that is radiated to a subject, including: a microphone with a reception circuit that converts sounds produced by a subject to received signals; a snoring sound extraction block that extracts snoring sound information from received signals; a snoring sound impact evaluation block that evaluates the impact of snoring sound; and a signal generation block that generates signals to produce low frequency sound using a low frequency sound generator; and a low frequency sound generator with a transmission circuit that radiates low frequency sound to a subject.

Another aspect of the present solution is an anti-snoring method using low frequency sound that is radiated to a subject, including: a microphone with a reception circuit that converts sounds produced by a subject to received signals; a signal processing using one or more microprocessors that extract snoring sound information from received signals; a signal processing using one or more microprocessors that evaluate the impact of snoring sound; and a signal processing using one or more microprocessors that generate signals to produce low frequency sound using a low frequency sound generator; and a low frequency sound generator with a transmission circuit that radiates low frequency sound to a subject.

Further, the present invention includes the following aspects:

1. Anti-snoring apparatus using infrasound that is radiated to a subject includes: a microphone with a reception circuit that converts plural sounds produced by a subject to plural received signals; a snoring sound extraction block that extracts snoring sound information from plural received signals; a snoring sound impact evaluation block that evaluates the impact of snoring sound; and a signal generation block that generates signals to produce infrasound using an infrasound generator; and an infrasound generator with a transmission circuit that radiates infrasound to a subject.

2. Anti-snoring apparatus according to 1, using low-frequency sound that is radiated to a subject.

3. Anti-snoring apparatus according to 1, where plural infrasound generators and/or plural low-frequency sound generators are used, and the infrasound generators and/or low-frequency sound generators focus on one or more location of the subject body.

4. Anti-snoring apparatus according to 1, where one or more cell phones are used, the cell phone converts plural sounds produced by a subject to plural received signals, the cell phone extracts snoring sound information from plural received signals, the cell phone evaluates the impact of snoring sound, and the cell phone generates signals to produce infrasound using an infrasound generator.

5. Anti-snoring apparatus according to 1, where plural snoring sounds are stored in the database and used in a snoring sound extraction block and/or a snoring sound impact evaluation block.

6. Anti-snoring apparatus according to 1, where the anti-snoring apparatus acquires plural snoring sounds of a subject; and plural snoring sounds of a subject is used in a snoring sound extraction block and/or a snoring sound impact evaluation block.

7. Anti-snoring apparatus according to 6, where a bedpartner of a subject can record plural snoring sounds of a subject.

8. Anti-snoring apparatus according to 6, where the anti-snoring apparatus acquires plural snoring sounds of a subject using plural snoring sound stored in the database.

9. Anti-snoring apparatus according to 1, where the anti-snoring apparatus has a function that transmits signals received by a microphone, sound information acquired by the snoring sound extraction block, judgement in the snoring sound impact evaluation block and/or information about infrasound radiation; the received signal and/or information are transferred to a data center through a wireless or a wired connection.

10. Anti-snoring apparatus according to 9, where the setting of the anti-snoring apparatus is updated through a wireless or a wired connection.

11. Anti-snoring apparatus according to 9, where the anti-snoring apparatus has a function that informs a part of the information acquired by the apparatus to a user and/or a third party, the information includes received signals, sound information acquired by the snoring sound extraction block, and sound information acquired by the snoring sound extraction block, judgement in the snoring sound impact evaluation block and/or information about infrasound radiation, and clinical advices assessed by the information acquired by the anti-snoring apparatus.

12. Anti-snoring method using infrasound that is radiated to a subject includes: a microphone with a reception circuit that converts plural sounds produced by a subject to plural received signals; a signal processing using one or more microprocessors that extract snoring sound information from plural received signals; a signal processing using one or more microprocessors that evaluate the impact of snoring sound; and a signal processing using one or more microprocessors that generate signals to produce infrasound using an infrasound generator; and an infrasound generator with a transmission circuit that radiates infrasound to a subject.

13. Anti-snoring apparatus using infrasound that is radiated to a snorer and infrasound for cancellation that is radiated to a bed partner includes: one or plural microphones with one or plural reception circuits that convert plural sounds produced by a subject to plural received signals; a snoring sound extraction block that extracts snoring sound information from plural received signals; a snoring sound impact evaluation block that evaluates the impact of snoring sound; a signal generation block that generates signals to produce infrasound using an infrasound generator and infrasound for cancellation using an infrasound canceller; an infrasound generator with a transmission circuit that radiates infrasound to a snorer; and an infrasound canceller with a transmission circuit that radiates infrasound for cancellation to a bed partner.

14. Anti-snoring apparatus according to 13, using low-frequency sound as a substitute for infrasound.

15. Anti-snoring apparatus according to 13, where plural infrasound cancellers is used, the infrasound cancellers suppress the impact of infrasound to neighbors laying both sides of the snorer.

16. Anti-snoring apparatus according to 13, where two or more infrasound generator-cancellers are used; one of the infrasound generator-cancellers radiates the snorer selectively when the one snores, and the other infrasound generator-canceller or other infrasound generator-cancellers radiate infrasound for cancellation to suppress the impact of infrasound to a bed partner.

17. Anti-snoring apparatus according to 13, where an infrasound canceller radiates infrasound for cancellation; the system controller calculates the signal for the radiation from an infrasound canceller using the estimated location of a snorer and that of a bed partner, and the infrasound for cancellation at a bed partner is close to the inversion of the infrasound at a bed partner.

18. Anti-snoring apparatus according to 17, where a system controller uses direction of infrasound generator and that of infrasound canceller for the estimation of the location of a snorer and that of a bed partner; the system controller supposes that the infrasound generator faces the snorer and the infrasound canceller faces the bed partner.

19. Anti-snoring apparatus according to 18, where a system controller uses one or plural delay circuits in order to prepare the signal for the radiation from an infrasound canceller.

20. Anti-snoring apparatus according to 17, where a system controller takes account of the attenuation caused by the propagation through a mattress when it calculates the signal for the radiation from an infrasound canceller.

21. Anti-snoring apparatus according to 17, where a system controller uses plural signals received by two or more microphones to estimate the location of a snorer and/or that of a bed partner.

22. Anti-snoring apparatus according to 17, where a system controller uses the information acquired by one or more infrared cameras to estimate the location of a snorer and/or that of a bed partner.

23. Anti-snoring apparatus according to 17, where a system controller uses the information acquired by one or more cameras to estimate the location of a snorer and/or that of a bed partner.

24. Anti-snoring apparatus according to 23, where a system controller uses the information acquired by one or more cell phone cameras to estimate the location of a snorer and/or that of a bed partner.

25. Anti-snoring method using infrasound that is radiated to a snorer and infrasound for cancellation that is radiated to a bed partner includes: one or plural microphones with one or plural reception circuits that convert plural sounds produced by a subject to plural received signals; a signal processing using one or more microprocessors, graphics processing units, and/or field-programmable gate arrays that extract snoring sound information from plural received signals; a signal processing using one or more microprocessors, graphics processing units and/or field-programmable gate arrays that evaluate the impact of snoring sound; a signal processing using one or more microprocessors, graphics processing units and/or field-programmable gate arrays that generate signals to produce infrasound using an infrasound generator and infrasound for cancellation using an infrasound canceller; an infrasound generator with a transmission circuit that radiates infrasound to a snorer; and an infrasound canceller with a transmission circuit that radiates infrasound for cancellation to a bed partner.

26. Anti-snoring apparatus using a noise-cancelling speaker that radiates sound for cancellation of noise, comprising: one or plural microphones with one or plural reception circuits that convert plural sounds produced by a subject to plural received signals; a snoring sound extraction block that extracts snoring sound information from plural received signals; a snoring sound impact evaluation block that evaluates the impact of snoring sound; a signal generation block that generates two kinds of signals in order to produce sound for cancellation of noise using a noise-cancelling speaker and to produce stimulation applied to a snorer using a stimulation device; a stimulation device with a stimulation generation circuit that applies stimulation to a snorer; and a noise-cancelling speaker with a transmission circuit that radiates sound for cancellation of noise to a bed partner.

27. Anti-snoring apparatus according to 26, using low frequency sound as stimulation to a snorer.

28. Anti-snoring apparatus according to 26, using ultrasound as stimulation to a snorer.

29. Anti-snoring apparatus according to 26, using audible sound as stimulation to a snorer.

30. Anti-snoring apparatus according to 26, using wind flow as stimulation to a snorer.

31. Anti-snoring apparatus according to 26, using light stimulation as stimulation to a snorer.

32. Anti-snoring apparatus according to 26, using thermal stimulation as stimulation to a snorer.

33. Anti-snoring apparatus according to 26, using electrical stimulation as stimulation to a snorer.

34. Anti-snoring apparatus according to 27, where two or more low frequency sound generator-noise cancellers are used, two or more microphones are used, and a snorer detection block is used; the snorer detection block determines which is the snorer among sleepers, the low frequency sound generator-noise canceller that directs to the snorer radiates low frequency sound to the snorer, and the low frequency generator-noise canceller that directs to a sleeper without snoring radiates sound for cancellation of noise to the sleeper.

35. Anti-snoring apparatus according to 34, where the low frequency sound generator-noise canceller that directs to the snorer radiates infrasound to the snorer.

36. Anti-snoring apparatus according to 34, where two or more microphones are used for each sleeper, and the low frequency sound generator has a driving unit; the snorer detection block determines the direction of arrival of the snoring sound, and the driving unit directs the low frequency sound generator to the direction of arrival of the snoring sound.

37. Anti-snoring apparatus according to 36, where time-of-flight depth sensors are used for each sleeper; the snorer detection block with the time-of-flight depth sensors determines the direction of the snorer head using the time-of-flight method.

38. Anti-snoring apparatus according to 36, where ultra-wide-band radar sensors are used for each sleeper; the snorer detection block determines the direction of the snorer head using the information acquired by the ultra-wide-band radar sensors.

39. Anti-snoring method using sound for cancellation of noise includes: one or plural microphones with one or plural reception circuits that convert plural sounds produced by a subject to plural received signals; a signal processing using one or more microprocessors that extracts snoring sound information from plural received signals; a signal processing using one or more microprocessors that evaluates the impact of snoring sound; a signal generation circuit generates two kinds of signals in order to produce sound for cancellation of noise using a noise-cancelling speaker and to produce stimulation applied to a snorer using a stimulation device; a stimulation device with a stimulation generation circuit that applies stimulation to a snorer; and a noise-cancelling speaker with a transmission circuit that radiates sound for cancellation of noise to a bed partner.

Obviously, numerous modifications and variations of the present invention are possible in light of the above teachings. It is therefore to be understood that within the scope of the appended claims, the invention may be practiced otherwise than as specifically described herein.

CITATION LIST NON PATENT LITERATURE

NPL 8 E. Dafna, A. Tarasiuk, Y. Zigel, "Automatic detection of whole night snoring events using non-contact microphone," PLoS One. 2013; 8(12): e84139.

NPL 9 http://www.audioholics.com/room-acoustics/bass-the-physical-sensation-of-sound The patents and publications cited in the present application are incorporated herein by reference in their entireties.

REFERENCE SIGNS LIST

000 snorer
002 snoring sound
004 microphone
006 infrasound generator
008 infrasound
010 system controller
012 reception circuit
014 snoring sound extraction block
016 snoring sound impact evaluation block
018 signal generation block
020 transmission circuit
200 bed
202 bed partner
400 infrasound canceller
402 infrasound for cancellation
500 neighbor
600 potential snorer
602 infrasound generator-canceller
700 S
702 B
704 $R_G$
706 $R_C$
708 $O_G$
710 $O_C$
800 stimulation
802 stimulation generation circuit
804 noise-cancelling speaker
806 sound for cancellation of noise
808 stimulation device
900 low frequency sound
902 low frequency sound generator
1000 low frequency sound generator-noise canceller
1002 snorer detection block
1100 driving unit
1500 infrared camera

What is claimed is:

1. An anti-snoring apparatus, comprising:

a low frequency sound generating device configured to apply a low frequency sound to a subject producing a snoring sound; and a controller comprising circuitry configured to convert the snoring sound to a received signal comprising an electrical signal, obtain snoring sound information from the received signal, process the snoring sound information such that an impact comprising sound pressure of the snoring sound is determined based on the snoring sound information, and cause the low frequency sound generating device to apply the low frequency sound to the subject when the impact is higher than a threshold such that the low frequency sound generating device applies the low frequency sound under constraint of unawareness of a low frequency sound radiation to the subject.

2. The anti-snoring apparatus of claim 1, wherein the low frequency sound comprises an infrasound.

3. The anti-snoring apparatus of claim 1, wherein the low frequency sound generating device comprises a plurality of low frequency sound generators.

4. The anti-snoring apparatus of claim 1, further comprising:

a sound receiving device configured to receive the snoring sound produced by the subject.

5. The anti-snoring apparatus of claim 4, wherein the sound receiving device comprises a plurality of microphones.

6. The anti-snoring apparatus of claim 5, further comprising:

a driving unit connected to the low frequency sound generator, wherein the circuitry of the controller is configured to determine which direction the snoring sound comes from based on a feedback from the microphones and direct the low frequency sound generating device to the direction determined.

7. The anti-snoring apparatus of claim 1, further comprising:

a sound canceling device configured to apply to at least one person next to the subject a low frequency sound that suppresses the impact of the snoring sound.

8. The anti-snoring apparatus of claim 7, wherein the low frequency sound applied to the at least one person comprises an infrasound.

9. The anti-snoring apparatus of claim 7, wherein the sound cancelling device comprises a plurality of low frequency sound cancellers.

10. The anti-snoring apparatus of claim 1, further comprising:

a noise-canceling device configured to apply to a second subject next to the first subject a sound that cancels the snoring sound.

11. An anti-snoring apparatus, comprising:

a first sound generator-canceller configured to apply a first low frequency sound to a first subject, a second sound generator-canceller configured to apply a second low frequency sound to a second subject next to the first subject; and a controller comprising circuitry configured to detect whether the first or second subject produces snoring sound, convert the snoring sound to a received signal comprising an electrical signal, obtain snoring sound information from the received signal, process the snoring sound information such that an impact comprising sound pressure of the snoring sound is determined based on the snoring sound information, cause one of the first and second sound generator-cancellers to apply a respective one of the first and second low frequency sounds to a respective one of the first and second subjects when the impact is higher than a threshold such that the one of the first and second sound generator-cancellers applies the respective one of the first and second low frequency sounds under constraint of unawareness of a respective one of first and second low frequency sound radiations to the respective one of the first and second subjects, and cause the other one of the first and second sound generator-cancellers to apply the other one of the first and second low frequency sounds that suppresses the impact of the snoring sound to the other one of the first and second subjects.

12. The anti-snoring apparatus of claim 11, wherein the first and second low frequency sounds each comprise an infrasound.

13. The anti-snoring apparatus of claim 11, further comprising:

a sound receiving device configured to receive the snoring sound produced by the first or second subject.

14. The anti-snoring apparatus of claim 13, wherein the sound receiving device comprises a plurality of microphones.

15. The anti-snoring apparatus of claim 14, wherein the circuitry of the controller is configured to receive a plurality of signals received from the microphones and detect locations of the first and second subjects.

16. The anti-snoring apparatus of claim 15, wherein when the first subject produces the snoring sound, a phase of the infrasound applied to the second subject is approximately an inversion of the infrasound applied to the first subject.

17. An anti-snoring apparatus, comprising:

a stimulation device configured to apply a stimulation to a first subject producing a snoring sound;

a noise-canceling device configured to apply to a second subject next to the first subject a sound that cancels the snoring sound; and a controller comprising circuitry configured to convert the snoring sound to a received signal comprising an electrical signal, obtain snoring sound information from the received signal, process the snoring sound information such that an impact comprising sound pressure of the snoring sound is determined based on the snoring sound information, cause the stimulation device to apply the stimulation to the first subject when the impact is higher than a threshold such that the stimulation device applies the stimulation under constraint of unawareness of a stimulation generation to the first subject, and cause the noise-canceling device to apply to the second subject the sound that cancels the snoring sound.

18. The anti-snoring apparatus of claim 17, wherein the stimulation comprises a low frequency sound.

19. The anti-snoring apparatus of claim 17, wherein the stimulation comprises an ultrasound.

20. The anti-snoring apparatus of claim 17, wherein the stimulation comprises an audible sound.

21. The anti-snoring apparatus of claim 17, wherein the stimulation comprises wind flow.

22. The anti-snoring apparatus of claim 17, wherein the stimulation comprises light stimulation.

23. The anti-snoring apparatus of claim 17, wherein the stimulation comprises thermal stimulation.

24. The anti-snoring apparatus of claim 17, wherein the stimulation comprises electrical stimulation.

25. An anti-snoring method, comprising:

converting a snoring sound produced by a subject to a received signal comprising an electrical signal;

obtaining snoring sound information from the received signal;

processing the snoring sound information such that an impact comprising sound pressure of the snoring sound is determined based on the snoring sound information; and applying a low frequency sound to the subject when the impact is higher than a threshold such that the low frequency sound under constraint of unawareness of a low frequency sound radiation is applied to the subject.

26. The anti-snoring method of claim 25, wherein the applying of the low frequency sound comprises applying an infrasound to the subject.

27. The anti-snoring method of claim 25, further comprising:

receiving the snoring sound wirelessly before the converting.

28. An anti-snoring method, comprising:

detecting whether a first subject or a second subject next to the first subject produces snoring sound;

converting the snoring sound to a received signal comprising an electrical signal;

obtaining snoring sound information from the received signal;

processing the snoring sound information such that an impact comprising sound pressure of the snoring sound is determined based on the snoring sound information;

applying one of a first low frequency sound and a second low frequency sound to a respective one of the first and second subjects when the impact is higher than a threshold such that the respective one of the first and second low frequency sounds under constraint of unawareness of a respective one of first and second low frequency sound radiations is applied to the respective one of the first and second subjects; and applying the other one of the first and second low frequency sounds that suppresses the impact of the snoring sound to the other one of the first and second subjects.

29. An anti-snoring method, comprising:

converting a snoring sound to a received signal comprising an electrical signal;

obtaining snoring sound information from the received signal;

processing the snoring sound information such that an impact comprising sound pressure of the snoring sound is determined based on the snoring sound information;

applying a stimulation to a first subject when the impact is higher than a threshold such that the stimulation under constraint of unawareness of a stimulation generation is applied to the first subject; and applying to a second subject next to the first subject a sound that cancels the snoring sound.

30. A non-transitory computer readable medium having stored thereon a program that when executed by a computer, causes the computer to execute an anti-snoring method, comprising:

converting a snoring sound produced by a subject to a received signal comprising an electrical signal;

obtaining snoring sound information from the received signal;

processing the snoring sound information such that an impact comprising sound pressure of the snoring sound is determined based on the snoring sound information; and applying a low frequency sound to the subject when the impact is higher than a threshold such that the low frequency sound under constraint of unawareness of a low frequency sound radiation is applied to the subject.

* * * * *